US007008131B2

(12) United States Patent
Kagevarna et al.

(10) Patent No.: US 7,008,131 B2
(45) Date of Patent: Mar. 7, 2006

(54) COMPOSITE HOLDING DEVICE

(75) Inventors: Hidehei Kagevarna, Kawagoe (JP); Tadashi Yamamoto, Kawagoe (JP); Tadayoshi Ebinuma, Kawagoe (JP); Sachio Arai, Kawagoe (JP)

(73) Assignee: Kotobuki & Co., Ltd., Kawagoe (JP)

( * ) Notice: Subject to any disclaimer, the term of this patent is extended or adjusted under 35 U.S.C. 154(b) by 15 days.

(21) Appl. No.: 10/026,467

(22) Filed: Dec. 27, 2001

(65) Prior Publication Data

US 2002/0085874 A1 Jul. 4, 2002

(30) Foreign Application Priority Data

Dec. 28, 2000 (JP) ..... 2000-401281
Jan. 12, 2001 (JP) ..... 2001-005638
May 30, 2001 (JP) ..... 2001-162133

(51) Int. Cl.
*B43K 27/00* (2006.01)

(52) U.S. Cl. ..... 401/30; 401/31; 401/32; 401/33; 401/35

(58) Field of Classification Search ..... 401/34, 401/35, 29, 30, 31, 32, 33
See application file for complete search history.

(56) References Cited

U.S. PATENT DOCUMENTS 1,992,961 A * 3/1935 Michael ..... 401/34 X
4,227,822 A 10/1980 Kokubu
4,533,271 A * 8/1985 Sansevero ..... 401/32 X
4,948,285 A * 8/1990 Schleif ..... 401/30 X
6,412,998 B1 * 7/2002 Ham ..... 401/34 X

FOREIGN PATENT DOCUMENTS

JP 55-38280 10/1980

* cited by examiner

*Primary Examiner*—Tuan Nguyen
(74) *Attorney, Agent, or Firm*—McGinn IP Law Group, PLLC

(57) ABSTRACT

A composite holding device, includes a casing for accommodating a plurality of holders for holding media to serve either different or similar purposes, a supporting section for supporting the holders to be movable in an axial direction in the casing, a feed mechanism, provided in the casing, for selectively advancing one of the plurality of holders, and a manipulating mechanism for operating the feed mechanism, to project the tip of one of the plurality of holders out of a fore end opening at the tip of the casing and make usable the tip of one of the plurality of holders. A supported section of each holder supported by the supporting section is rotatably supported in relation to the supporting section.

22 Claims, 22 Drawing Sheets

COMPOSITE HOLDING DEVICE

BACKGROUND OF THE INVENTION

1. Field of the Invention

The present invention relates to a composite holding device housing a plurality of holders for holding media for writing-related use (e.g., a pencil lead, an ink, a stick glue, an eraser and a correctional fluid), cosmetic media (e.g., a lipstick, an eye pencil, an eyeliner and an eyebrow pencil) or data inputting media (e.g., a stylus tip) and selectively projecting one of the plurality of holders to make it available for use.

2. Description of the Related Art

Known composite holding devices include, for instance, one described in Japanese Patent Publication No. 55-38280. This conventional composite holding device has a sleeve case having a fore end opening, a guide fixed to the rear end opening of the sleeve case and having two guide grooves extending in the axial direction and opposite each other diametrically, a mechanical pencil element (holder) and a ballpoint element (holder), each having a slider guided by the matching guide groove, and a sleeve acting cam surrounding the guide so as to be rotatable to the guide within a certain angle range and to be capable of transitioning in the axial direction with respect to the guide. The cam has a cam slide face formed on its lower end face to engage with the slider so that the cam, when turning in one direction, causes the tip of one of the two holders to project out of the fore end opening of the sleeve case and, when turning in the other direction, causes this holder to recede and the tip of the other holder to project out of the fore end opening of the sleeve case.

However, at the eccentric position away from the axial center of the sleeve case, the mechanical pencil element or the ballpoint element (e.g., which are holders) is accommodated in the sleeve case, whereas the fore end opening of the sleeve case, which is the projecting position of the holder, is on the axial center of the sleeve case, resulting in a positional gap in the radial direction between these positions.

Consequently, in this conventional configuration, as a holder advances, the tip of the holder shifts toward the fore end opening of the sleeve case in contact with the inner circumferential face of the sleeve case while being forcibly deviated in the radial direction of the sleeve case. As a result, the tip of the holder may be caught by the inner circumferential face of the sleeve case and thereby prevented from projecting out of the fore end opening of the sleeve case. This leads to limited freedom in the choice of the material or the dimensions of the holders because the holders should be made of a flexible material, or some allowance should be given in the length of the holders in the axial direction to make them more bendable.

Furthermore, the above-mentioned conventional composite holding device only permits selective use of one of two holders, comprising a mechanical pencil element (holder) holding a pencil lead and a ballpoint element (holder) holding ink. Thus, its range of applicability is narrow because the number of media is limited to a mechanical pencil and a ballpoint pen having only one color.

BRIEF SUMMARY OF THE INVENTION

In view of the foregoing and other problems, drawbacks, and disadvantages of the conventional methods and structures, an object of the present invention is to provide a composite holding device enabling a holder, among a plurality of accommodated holders, to be advanced and its tip to be smoothly projected out of the fore end opening of a casing, without being constrained by the material or dimensions of the holders, thereby increasing the freedom in the choice of the materials or the dimensions of the holders.

A second object of the present invention is to provide a composite holding device capable of holding a greater number of media than any existing composite holding device.

To achieve the objects stated above and others, according to a first aspect of the present invention, a composite holding device includes a casing for accommodating a plurality of holders for holding media to serve either different or similar purposes, a supporting section for supporting the holders to be movable in the axial direction in the casing, a feed mechanism, provided in the casing, for selectively advancing one of the plurality of holders, and a manipulating mechanism for working the feed mechanism. The feed mechanism is worked by operating the manipulating mechanism to project the tip of one of the plurality of holders out of the fore end opening at the tip of the casing. The supported section of each holder supported by the supporting section is rotatably supported in relation to the supporting section and allows the tip of one of the plurality of holders to be used.

As one of the plurality of holders is advanced by the working of the feed mechanism, its tip projects out of the fore end opening. Even if in this action there is a deviation between the position of the holder tip when the holder is accommodated in the casing and that of the holder tip when it is projected out of the fore end opening at the tip of the casing in the radial direction, the holder tip can project out of the fore end opening of the casing without causing the holder itself to be substantially bent or meet significant resistance as it abuts the inner circumferential face of the casing because the supported section of the holder rotates in relation to the is supporting section.

Therefore, since the holders need not be highly bendable, the material or length of the holders is not subjected to any major constraint, thereby resulting in an enhanced design freedom.

Further, formation of a spherical bearing between the supporting section and the supported section provided on each of the holders would enable the supported section to be rotatably supported by the supporting section. This spherical bearing may include a spherical part formed on either one of the supporting section and the supported section provided on a holder and a concave part formed on the other one of the supporting section and supported section provided on the holder to receive the spherical part.

The media can be selected out of a group of media including writing-related media including a pencil lead, an ink, a stick glue, an eraser and a correctional fluid, cosmetic media including a lipstick, an eye pencil, an eyeliner and an eyebrow pencil and data inputting media including a stylus tip. This composite holding device can further be built into the cap of a writing tool.

To further achieve the objects stated above and others, according to a second aspect of the invention, a composite holding device includes a holder body for holding a medium to serve a prescribed purpose and a cap for covering the holder body.

The cap preferably includes a casing for accommodating a plurality of holders, each for holding a medium to serve a purpose either different from or similar to that of the medium, a supporting section for supporting the holders to be movable in the axial direction in the casing, a feed mechanism, provided in the casing, for selectively advancing one of the plurality of holders, and a manipulating mechanism for working the feed mechanism, the feed mechanism being worked by operating the manipulating mechanism to project the tip of one of the plurality of holders out of the fore end opening at the tip of the casing and to allow the tip of one of the plurality of holders to be used.

Preferably, the holder body holds the medium, and a plurality of holders are housed in the casing of the cap, so that, by working the manipulating functions provided on the cap, any desired holder can be selectively projected out of the fore end opening at the tip of the casing to make it available for use. As a result, a greater number of media can be held to expand the range of applicability.

The casing preferably includes an external sleeve, an intermediate sleeve fitted inside the external sleeve with the assistance of an ancillary sleeve, and a nose rotatable in relation to the external sleeve and the intermediate sleeve, an internal thread is formed on an inner circumferential face of the intermediate sleeve and a slit is formed on the internally threaded part of the intermediate sleeve, and an external thread is formed on an outer circumferential face of the ancillary sleeve.

Preferably, the externally threaded part of the ancillary sleeve or the internally threaded part of the intermediate sleeve has a tapered shape, and the external thread of the ancillary sleeve inserted into the external sleeve and the intermediate sleeve engages the internal thread of the intermediate sleeve inserted into the external sleeve. The slit of the intermediate sleeve is expanded to press the internally threaded part against an inner circumferential face of the external sleeve to fix the intermediate sleeve to the external sleeve and thereby to fit the intermediate sleeve inside the external sleeve.

By a simple operation mainly including the threaded engagement of the intermediate sleeve with the ancillary sleeve, the intermediate sleeve can be fitted to the external sleeve with the assistance of the ancillary sleeve without adversely affecting the looks of the external sleeve. This manner of fitting is applicable even where the configuration forbids the rotation of the intermediate sleeve in relation to the external sleeve, threading is impossible on either the external sleeve or the intermediate sleeve, or either the intermediate sleeve or the external sleeve includes a non-adhesive material, resulting in an expanded range of applicability.

It is possible to form a projection to be pressed against the inner circumferential face of the external sleeve on the outer circumferential face of the internally threaded part of the intermediate sleeve. The projection can serve to enhance the binding force between the intermediate sleeve and the external sleeve. Further, an adhesive tape or elastic member can be formed between the outer Ad circumferential face of the internally threaded part of the intermediate sleeve and the inner circumferential face of the external sleeve, to further enhance the binding force is between the intermediate sleeve and the external sleeve.

Alternatively, the casing may include an external sleeve, an intermediate sleeve fitted inside the external sleeve with the assistance of an ancillary sleeve and an elastic ring, and a nose rotatable in relation to the external sleeve and the intermediate sleeve, an internal thread is formed on either one of the intermediate sleeve and the ancillary sleeve, and an external thread to engage with the internal thread is formed on the other one.

Preferably, the intermediate sleeve and the elastic ring adjacent to the intermediate sleeve in the axial direction, are inserted into the external sleeve, the ancillary sleeve is inserted into the external sleeve from the elastic ring side, one of a part of the ancillary sleeve and a part of the intermediate sleeve penetrates the elastic ring, and the threaded engagement of the external thread with the internal thread serves to combine the intermediate sleeve and the ancillary sleeve. The elastic ring is compressed in the axial direction between the ancillary sleeve and the intermediate sleeve to be pressed against an inner circumferential face of the external sleeve and thereby to be fixed to the external sleeve, thereby resulting in the fitting of the intermediate sleeve inside the external sleeve.

Where the intermediate sleeve is to be fitted to the external sleeve with the assistance of the ancillary sleeve and the elastic ring, as the elastic ring elastically contacts the ancillary sleeve and/or the intermediate sleeve to forbid the ancillary sleeve and the intermediate sleeve from rotating in relation to each other, the threaded engagement between the ancillary sleeve and the intermediate sleeve is prevented from loosening, thereby resulting in a secure fitting of the intermediate sleeve to the external sleeve.

On the ancillary sleeve, a step face may be formed to come into contact with the elastic ring, and the step face may be inclined in relation to the direction of the external diameter. In this case, the elastic ring is progressively pressed in the direction of the external diameter (i.e., against the inner circumferential face) of the external sleeve as the ancillary sleeve approaches the elastic ring.

Alternatively, the casing may include an external sleeve, an intermediate sleeve fitted inside the external sleeve with the assistance of an ancillary sleeve and a C-ring, and a nose rotatable in relation to the external sleeve and the intermediate sleeve, an annular concave part is formed on an inner circumferential face of the external sleeve, and the C-ring is fitted into the annular concave part to project more in the direction of the internal diameter than the inner circumferential face of the external sleeve, an internal thread is formed on either one of the intermediate sleeve and the ancillary sleeve, and an external thread to engage the internal thread is formed on the other one. A part of the intermediate sleeve may be inserted into the external sleeve from one end of the external sleeve, and the other part of the intermediate sleeve not inserted into the external sleeve is brought into contact with the one end of the external sleeve. Preferably, the ancillary sleeve is inserted into the external sleeve from the other end of the external sleeve, one of a part of the ancillary sleeve and a part of the intermediate sleeve penetrates the C-ring, the threaded engagement of the external thread and internal thread with each other serves to combine the intermediate sleeve and the ancillary sleeve, and the ancillary sleeve comes into contact with the part of the C-ring projecting more than the inner circumferential face of the external sleeve from the other end side of the external sleeve, thereby resulting in the fitting of the intermediate sleeve inside the external sleeve.

Where the intermediate sleeve is to be fitted to the external sleeve with the assistance of the ancillary sleeve and the C-ring, by bringing the ancillary sleeve into contact with the C-ring from the other end side of the external sleeve and bringing the part of the intermediate sleeve not inserted into the external sleeve into contact with one end of the external sleeve, the intermediate sleeve can be securely fitted to the external sleeve.

Where a part of the ancillary sleeve or a part of the intermediate sleeve penetrating the C-ring comes into frictional contact with the C-ring, as the ancillary sleeve and the intermediate sleeve are prohibited from rotation in relation to each other, the threaded engagement between the ancillary sleeve and the intermediate sleeve is prevented from loosening, thereby resulting in secure fitting of the intermediate sleeve to the external sleeve.

The present disclosure relates to subject matter contained in Japanese Patent Application No. Hei 2000-401281, filed on Dec. 28, 2000, Japanese Patent Application No. Hei 2001-5638, filed on Jan. 12, 2001, and Japanese Patent Application No. Hei 2001-162133, filed on May 30, 2000, and which are expressly incorporated herein by reference in their entirety.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF THE PREFERRED EMBODIMENTS

Figure 2:
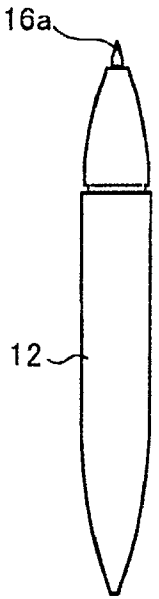
FIG. 2 illustrates a holder body 12.

Embodiments of the present invention will be described below with reference to the accompanying drawings. FIGS. 1–17 illustrate a first embodiment of the present invention.

In the drawings, reference numeral 10 denotes a whole writing tool as an example of composite holding device according to the invention. The writing tool 10 is mainly provided with a holder body 12 and a cap 14 detachably covering the holder body 12. Into the holder body 12 is incorporated a refill 16 having a ball at a tip 16*a* and containing ink, thereby enabling holder body 12 to hold ink. The cap 14, which is intended to protect the tip 16*a* of the refill 16 to prevent the ink within from evaporating and drying when the refill 16 is not in use, also has a composite holding device built into it.

Figure 4:
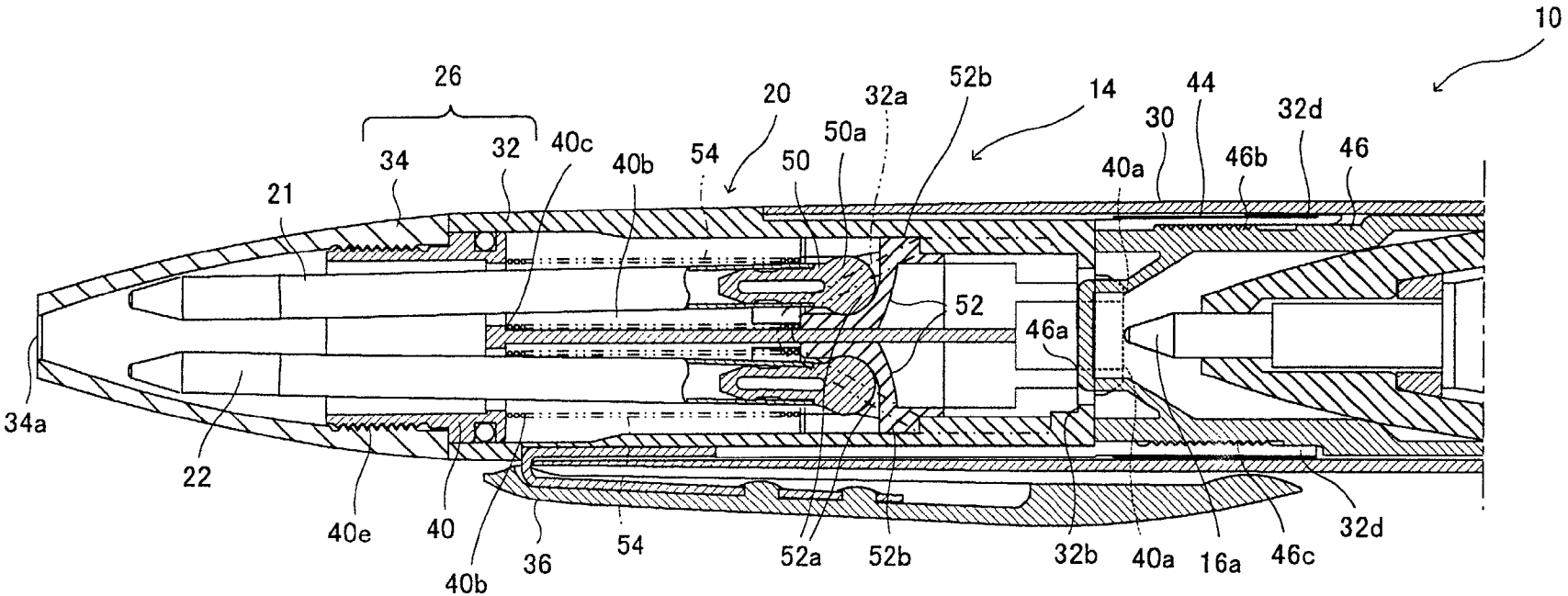
FIG. 4 shows an expanded view of the cap 14 in FIG. 3.

FIG. 4 shows an expanded view of the cap 14. The composite holding device built into the cap 14 is mainly provided with a casing 20 for accommodating a plurality of holders 21 and 22 substantially overlapping each other in the axial direction, a supporting section 23 for supporting a plurality of holders 21 and 22 to be movable in the axial direction within the casing 20, a feed mechanism 24, provided in the casing 20, for selectively projecting either one of the plurality of holders 21 and 22, and a manipulating mechanism 26 for working the feed mechanism 24, so that one or the other of the plurality of holders 21 and 22 can be selectively projected for use.

Figure 3:
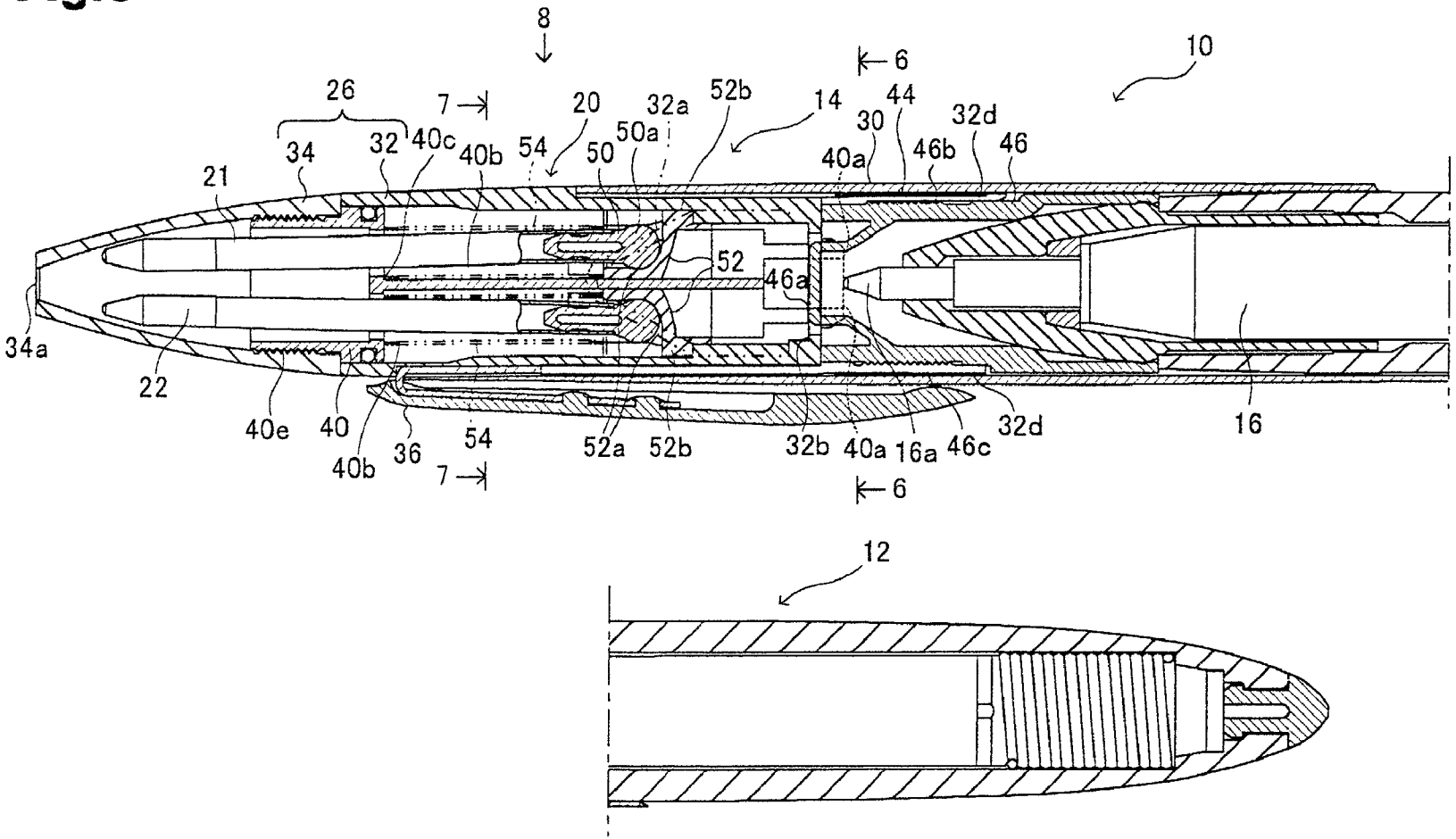
FIG. 3 shows a longitudinal section of the composite holding device 10, which is a first embodiment of the present invention.

The holders 21 and 22 in the illustrated example are two ballpoint stems containing inks differing from each other either in color or property. The constituent mechanisms will be described in detail below. Hereinbelow, the cap 14 side in FIG. 3 represents the "fore side", and the holder body 12 side represents the "rear side".

The casing 20 includes an external sleeve 30, an intermediate sleeve 32 and a nose 34. The rear end of the intermediate sleeve 32 is inserted into the external sleeve 30 and fixed there, and inside the intermediate sleeve 32 is fixed an internal sleeve 46 to serve as the ancillary sleeve.

The intermediate sleeve 32, whereas it can be fixed to the external sleeve 30 by adhesion or any other desired binding means, in this embodiment is integrally fitted to the external sleeve 30 with the assistance of the internal sleeve 46 as will be described in detail hereinbelow. The internal space of the internal sleeve 46 accommodates the tip 16*a* of the refill 16 of the holder body 12 when the holder body 12 is protected by the cap 14.

Figure 1:
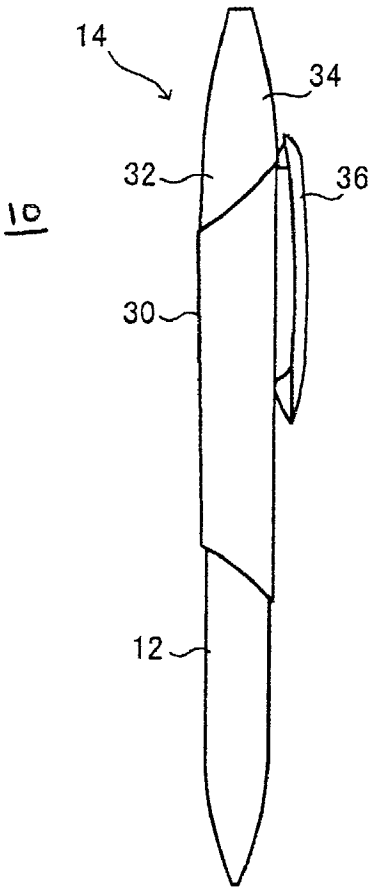
FIG. 1 shows an overall view of a composite holding device 10.

As shown in FIG. 1, the boundary shape linking the tip of the intermediate sleeve 32 not inserted into the external sleeve 30 but exposed to the outside, and the tip of the external sleeve 30 to each other, is not a true circle normal to the axial direction, but preferably is an ellipse inclined at an angle to the axial direction. Therefore, the external sleeve 30 and the intermediate sleeve 32 cannot rotate in relation to each other, and at the tip part of the inclined boundary ellipse the base of a clip 36 is pinched between the intermediate sleeve 32 and the external sleeve 30. The intermediate sleeve 32, external sleeve 30 and clip 36 also can be integrally formed having a unitary construction.

The nose 34 is arranged on a side of the tip of, and to be capable of rotating in relation to, the intermediate sleeve 32. Namely, the nose 34 is threaded onto a threaded part 40*e* formed on the outer circumferential face of the tip of a slide receptacle 40 arranged within the intermediate sleeve 32 of the casing 20, and the nose 34 and the slide receptacle 40 rotate integrally in a state in which the nose 34 is threaded on the slide receptacle 40. The tip of either one of the holders 21 and 22 is selectively projected out of an fore end opening 34*a* at the tip of the nose 34.

Figure 5:
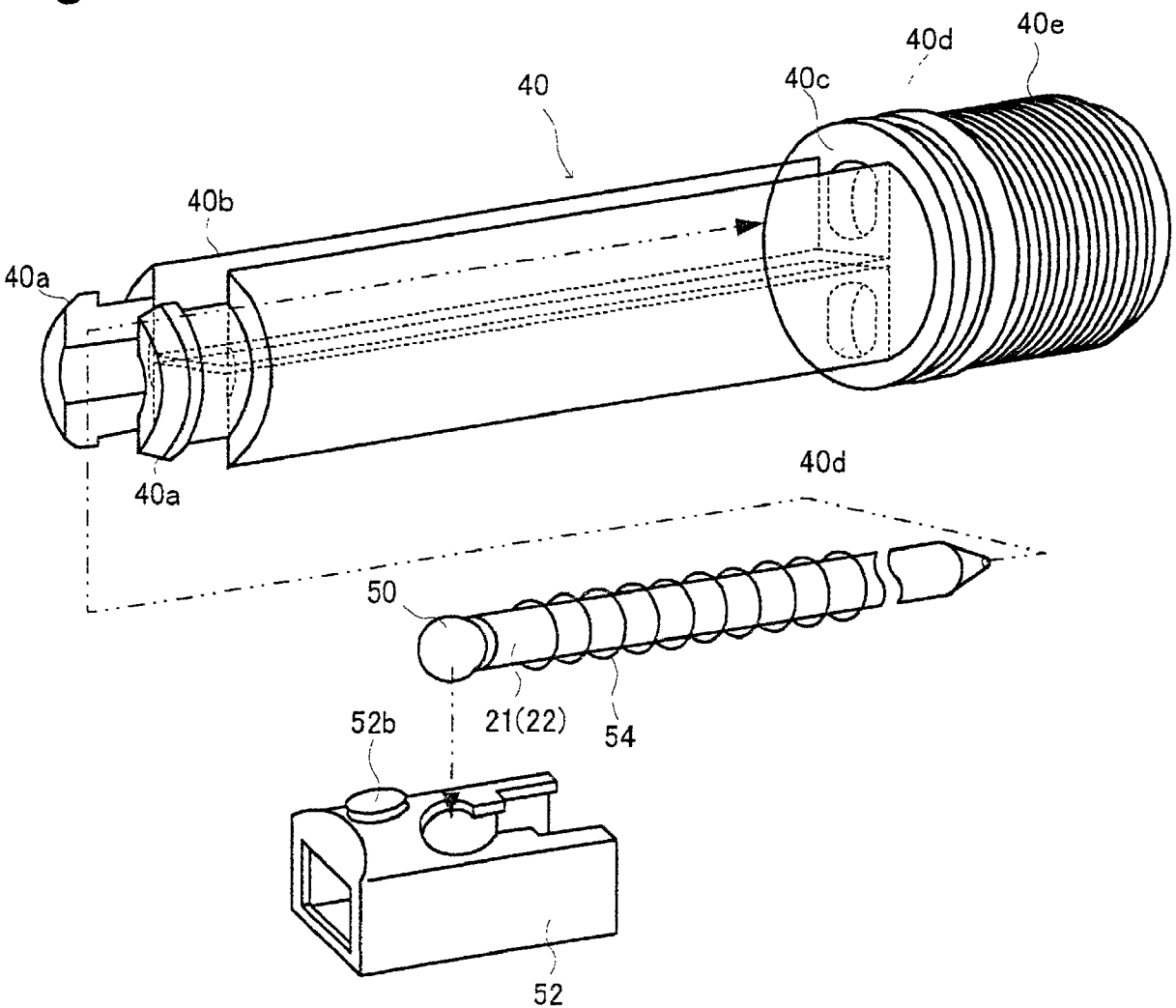
FIG. 5 shows of exploded perspective views of the slide receptacle 40, slider 52, holder receptacle 50, and holder 21 (22)
Figure 6:
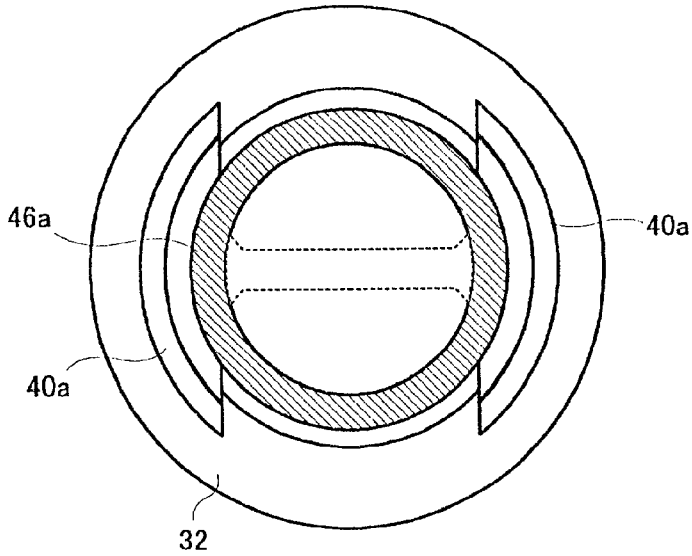
FIG. 6 shows a section of an engaging piece of the slide receptacle 40 as viewed along line 6—6 in FIG. 3 (partly abridged for brevity of description)
Figure 7:
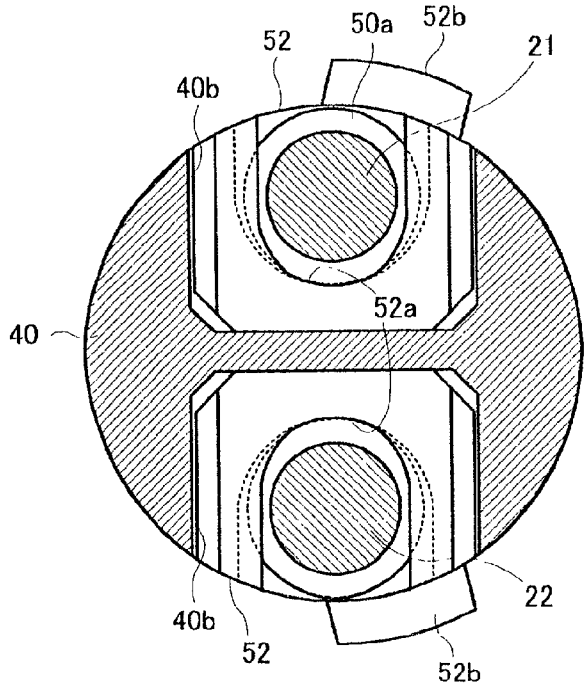
FIG. 7 shows a section of the slide receptacle 40, holder receptacle 50, and slider 52 as viewed along line 7—7 in FIG. 3 (partly abridged for brevity of description)
Figure 10A:
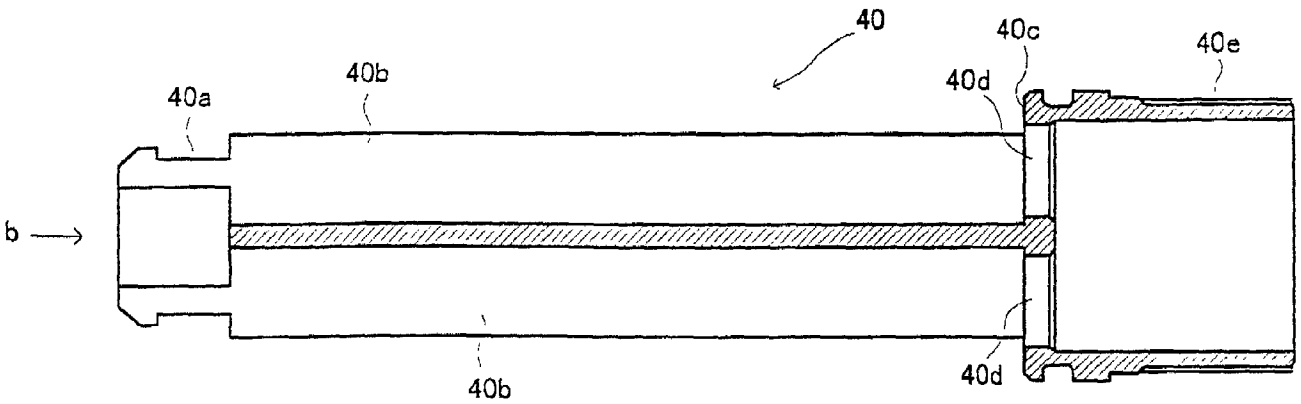
FIG. 10(*a*) shows a longitudinal section of the slide receptacle 40, and FIG. 10(*b*) shows a section of the same as viewed in the direction of arrow b.
Figure 10B:
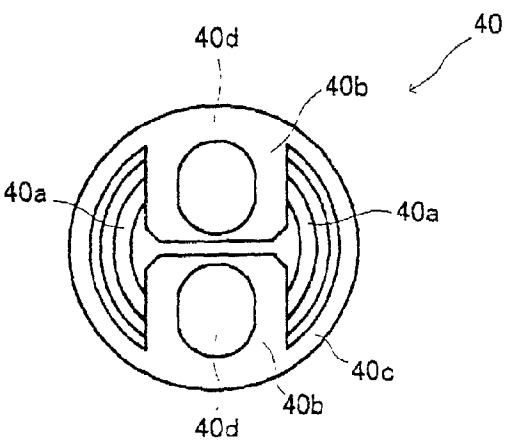

The slide receptacle 40 threaded into the nose 34 extends in the axial direction within the intermediate sleeve 32. As shown in FIGS. 5 and 10, at the rear end of the slide receptacle 40 are formed engaging pieces 40*a* and 40*a*, which are engaged with a stepped part 32*b*, formed at the rear end of the intermediate sleeve 32, to be rotatable relative thereto. Farther inside than the engaging pieces 40*a* and 40*a* in the radial direction is fitted a head part 46*a* of the internal sleeve 46 to prevent the engaging pieces 40*a* and 40*a* from falling inwardly in the radial direction and thereby not to let the engaging pieces 40*a* disengage the stepped part 32*b* (see FIG. 6).

Further, on the slide receptacle 40 are formed as many guide grooves 40*b* as the holders 21 and 22 to be accommodated extending in the axial direction, and the holders 21 and 22 are arranged within the respective guide grooves 40*b* to be movable in the axial direction. Namely, at the rear end of each of the holders 21 and 22 is provided a holder receptacle 50 as the supported section. The holder receptacle 50 is supported by a slider 52, which is the supporting section 23, and the slider 52 is slidably fitted into the guide groove 40*b* of the slide receptacle 40 (see FIG. 7).

Figure 8:
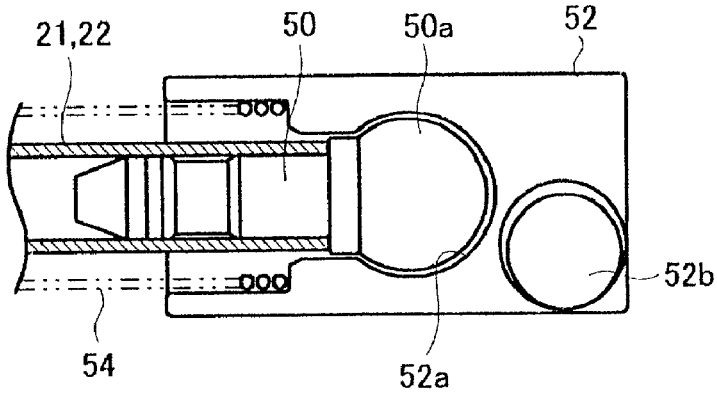
FIG. 8 illustrates the slider 52 and holder receptacle 50 as viewed in the direction of arrow 8 in FIG. 3.
Figure 9:
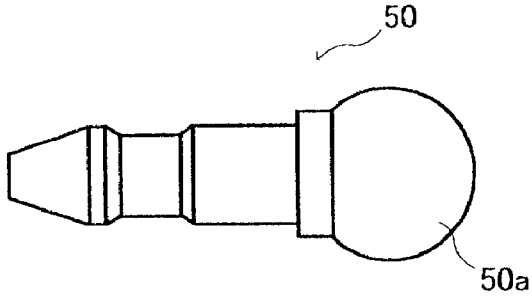
FIG. 9 shows a plan view of the holder receptacle 50.

As shown in FIGS. 8 and 9, the tip of the holder receptacle 50 is inserted into a ballpoint stem, which is the holder 21 or 22, and its rear part constitutes a spherical part 50*a*. On the other hand, a concave part 52*a* for bearing the spherical part 50*a* is formed on its inner circumferential face of the slider 52. The spherical part 50*a* and the concave part 52*a* constitute a spherical bearing to rotatably bear the holder receptacle 50 with a freedom of angle in relation to the slider 52.

Figure 11:
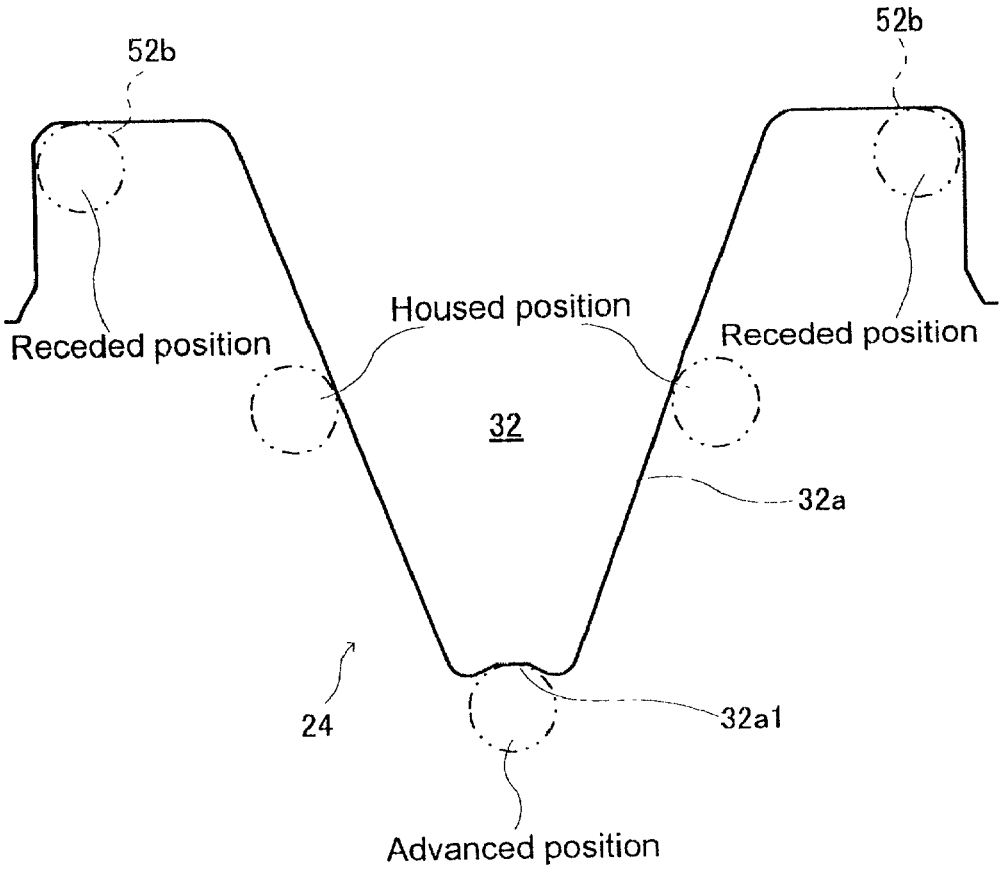
FIG. 11 shows an expansion plan of a cam face 32*a* of an intermediate sleeve 32.

On the inner circumferential face of the front portion of the intermediate sleeve 32 is formed a cam face 32*a* including a forward step face and inclined in the axial direction, and a projection 52*b* of the slider 52 is in contact with this cam face 32*a*. This cam face 32*a* is substantially V-shaped as the expansion plan view of FIG. 11 shows, and its projecting end is positioned toward the tip. At this projecting end is formed an engaging part 32*a*1 constituting a small dent in the cam face 32*a*. The projection 52*b* of the slider 52 can slide along this cam face 32*a*. To ensure the contact of the slider 52 with the cam face 32*a*, a return spring 54 intervenes between the slider 52 and a partition wall 40*c* of the slide receptacle 40, so that the return spring 54 pushes the slider 52 backward.

As shown in FIG. 10, through holes 40*d* and 40*d* are formed on the partition wall 40*c* to let the holders 21 and 22 pass through, and each of the through holes 40*d* is not circular but elliptical, longer in the radial direction.

The above-described cam face 32*a* and the projection 52*b* of the slider 52 include the feed mechanism 24, and the nose 34 and the intermediate sleeve 32 (or the external sleeve 30) enabled to rotate in relation to each other include the manipulating mechanism 26.

As will be described in detail below, in order for the holders 21 and 22 to be projected and receded reliably, it is necessary for the intermediate sleeve 32, on which the cam face 32*a* is formed, to be securely fitted to and integrated with the external sleeve 30. The structure and method for this assembly will be described below.

Figure 12:
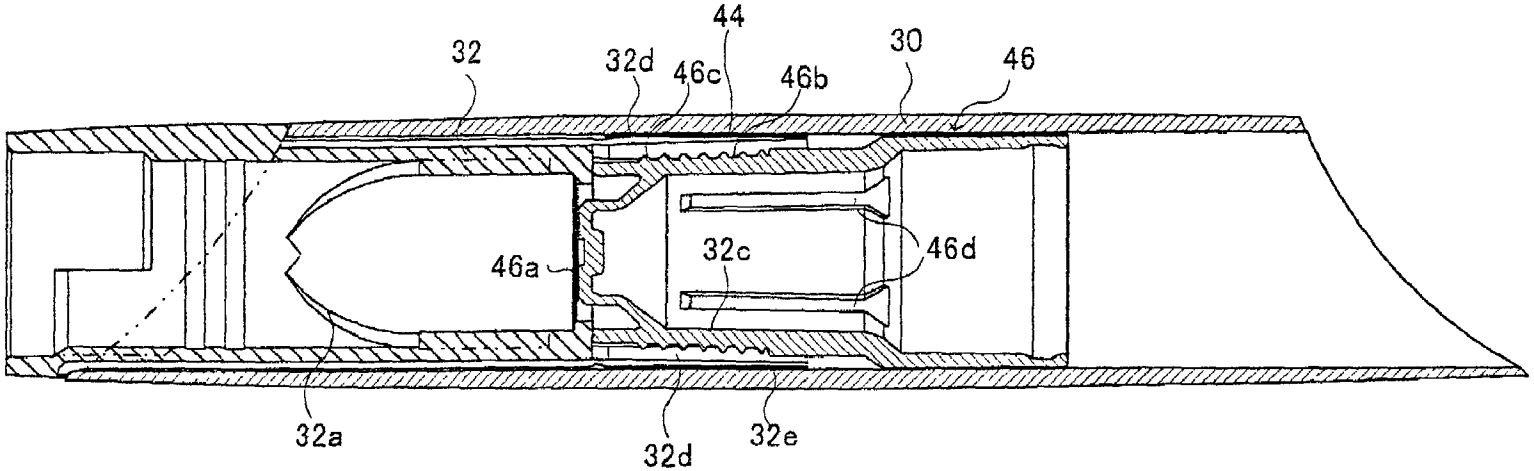
FIG. 12 shows an expanded section of the fitting structure illustrated in FIG. 3.
Figure 13A:
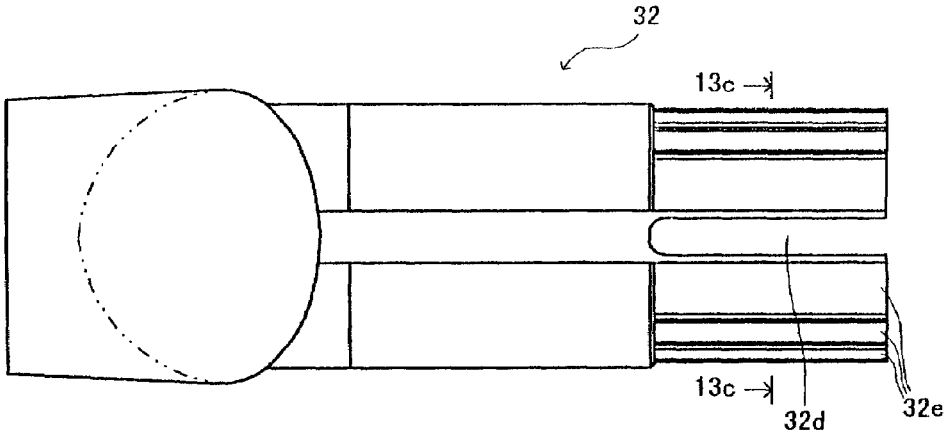
FIGS. 13(*a*)–13(*c*) illustrate the intermediate sleeve 32 of the fitting structure shown in FIG. 3, with FIG. 13(*a*) showing a plan view, FIG. 13(*b*) showing a sectional view, and FIG. 13(*c*) showing another sectional view as viewed along 13*c*—13*c* in FIG. 13(*a*)
Figure 13B:
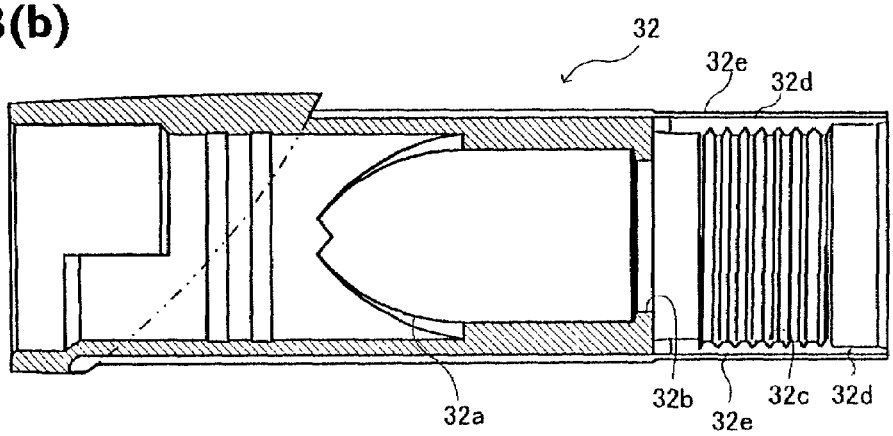
Figure 13C:
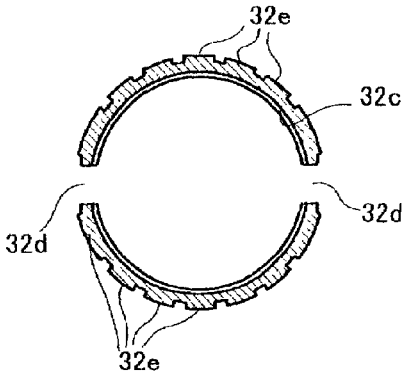

As shown in FIGS. 12 and 13, an internal thread 32*c* is formed on an inner circumferential face of the rear end of the intermediate sleeve 32, and on the intermediate sleeve 32 a pair of mutually opposite slits 32*d*, extending from the end part in the axial direction, are further formed on its internally threaded part where the internal thread 32*c* is formed. The number of slits 32*d* is not limited to two as in this case, but may be one, or three or more. Further on an outer circumferential face of the internally threaded part of the intermediate sleeve 32 are formed a plurality of projections 32*e* extending in the axial direction, appropriately separated from each other in the circumferential direction. Preferably, an elastic ring (elastic member) 44 may be mounted on the outer circumferential face of the internally threaded part of this intermediate sleeve 32. The elastic ring 44 may include an elastomer, soft synthetic resin or the like.

Figure 14A:
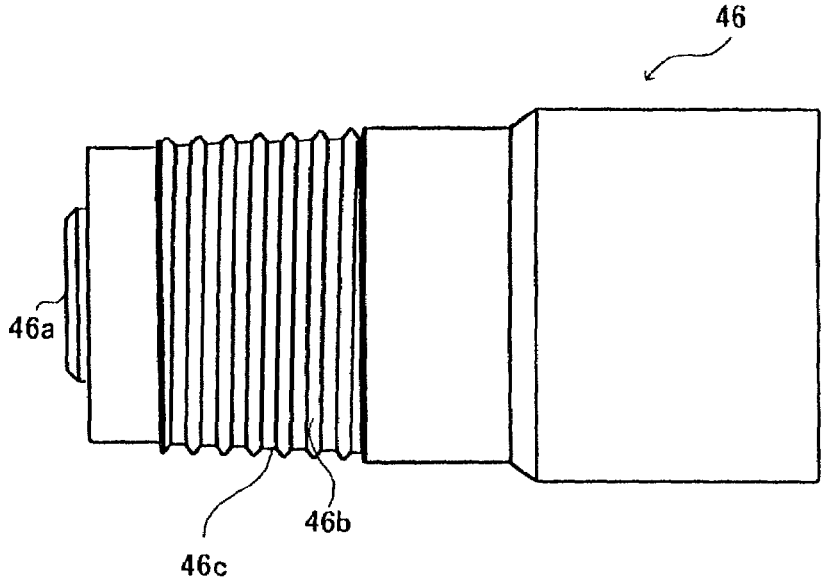
FIGS. 14(*a*) and 14(*b*) illustrate an internal sleeve 46 of the fitting structure shown in FIG. 3, with FIG. 14(*a*) showing a plan view, and FIG. 14(*b*) showing a sectional view.
Figure 14B:
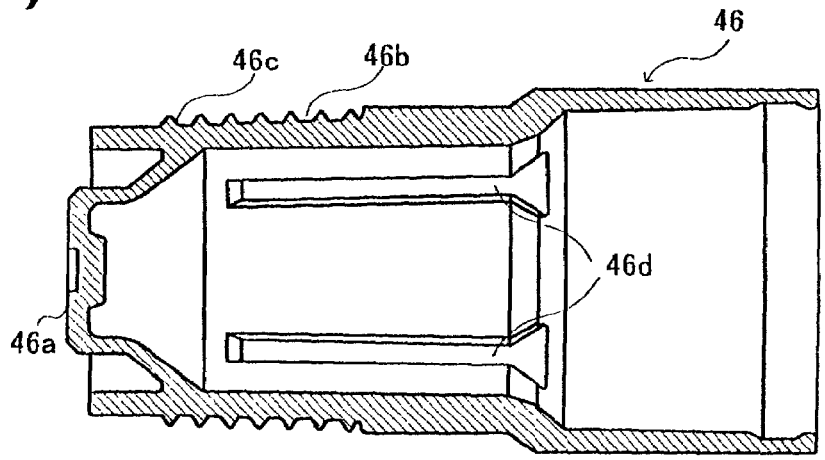

Further, as shown in FIGS. 12 and 14, on an outer circumferential face of the tip of (or a part of) an internal sleeve 46 is formed an external thread 46*b* to engage with the internal thread 32*c*, and an outer circumferential face of this externally threaded part constitutes a tapered face 46*c* whose external diameter gradually increases from the tip toward the rear part. Tool grooves 46*d* for letting in screw drivers and other tools for fitting use are also formed at appropriate intervals in the circumferential direction on an inner circumferential face of the internal sleeve 46.

Figure 15:
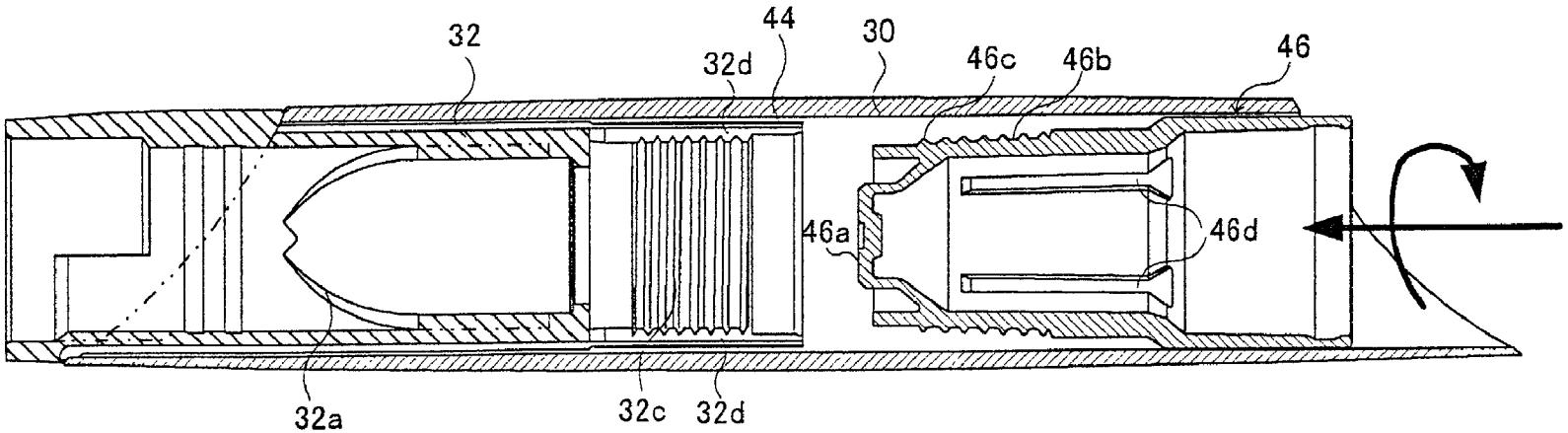
FIG. 15 shows a section of an interim state of the assembly of the first embodiment of the invention, corresponding to the drawing shown in FIG. 12.

The assembly operation is performed as follows. First, the rear end of the intermediate sleeve 32 is inserted into the external sleeve 30 and set in a suitable position. Then, as shown in FIG. 15, the internal sleeve 46 is inserted into the external sleeve 30 and into the intermediate sleeve 32, and a tool is placed into the tool grooves 46*d* on the inner circumferential face of the internal sleeve 46 to turn the internal sleeve 46, thereby to screw the external thread 46*b* in the tip part of the internal sleeve 46 onto the internal thread 32*c* on the intermediate sleeve 32.

As the threading operation is continued, the tapered face 46*c* of the internal sleeve 46 expands the slits 32*d* at the rear end of the intermediate sleeve 32 to expand the internally threaded part of the intermediate sleeve 32 in the direction of the external diameter. As a result, the intermediate sleeve 32, especially its projections 32*e*, is pressed toward an inner circumferential face of the external sleeve 30. In this process, the elastic ring 44 mounted on the outer circumferential face of the internally threaded part of the intermediate sleeve 32 is compressed between the outer circumferential face of the intermediate sleeve 32 and the inner circumferential face of the external sleeve 30.

This causes the rear end of the intermediate sleeve 32 to be fitted to the inner circumferential face of the external sleeve 30, so that the intermediate sleeve 32 is firmly fixed to the external sleeve 30. Thus, the assembly operation can be accomplished efficiently, instead of taking a long time as adhesion would, without adversely affecting the appearance of the external sleeve 30. Further, as the projections 32*e* formed at appropriate intervals on the outer circumferential face of the intermediate sleeve 32 press the elastic ring 44 farther toward the inner circumferential face of the external sleeve 30, the friction may be increased with the inner circumferential face of the external sleeve 30 and accordingly the binding force.

However, a double or single-face adhesive tape can be set between the outer circumferential face of the intermediate sleeve 32 and the inner circumferential face of the external sleeve 30 in place of the elastic ring 44. The adhesive tape may be a pressure-sensitive adhesive tape. Where an adhesive tape is used, it may be preferable to dispense with the projections 32*e* on the outer circumferential face of the intermediate sleeve 32. Or, if desired, neither an adhesive tape nor the elastic ring 44 need be used, but instead the outer circumferential face of the intermediate sleeve 32 can be crimped directly onto the inner circumferential face of the external sleeve 30.

In the illustrated example, the outer circumferential face of the externally threaded part of the internal sleeve 46 is tapered. However, it is also conceivable to taper the inner circumferential face of the internally threaded part of the intermediate sleeve 32, so that the slits 32*d* of the intermediate sleeve 32 can be expanded as the screwing onto the internal sleeve 46 advances to expand the internally threaded part of the intermediate sleeve 32 in the direction of the external diameter.

The tips of both holders 21 and 22 of the cap 14 (into which the composite holding device configured as described above is incorporated) are positioned inwardly of the fore end opening 34*a* of the nose 34, and housed substantially overlapping each other in the axial direction in the state illustrated in FIG. 3. In this state, the projection 52*b* of the slider 52 supporting the holder receptacle 50 of each of the holders 21 and 22 is in an intermediate position of the cam face 32*a* (e.g., the position of accommodation in FIG. 11).

The use of either one of the holders 21 and 22 is accomplished in the following manner. Namely, the nose 34 is turned in a prescribed direction in relation to the intermediate sleeve 32, which causes the slide receptacle 40 integrated with the nose 34 to be turned in the prescribed direction in relation to the intermediate sleeve 32. As the sliders 52 and 52 fitted into the guide grooves 40*b* of the slide receptacle 40 also turn integrally, each of the projections 52*b* of the sliders 52 moves in the axial direction along the cam face 32*a*, and one of the two sliders 52 advances, whereas the other recedes.

If the holder receptacle 50 of the holder 21 is supported by the advanced slider 52, then the holder 21 will advance together with the slider 52. Then, the spherical part 50*a* of the holder receptacle 50 of the advanced holder 21, as the receptacle advances, comes into sliding contact with the concave part 52*a* and turns from the state in which the holder receptacle 50 is on the same straight line as the slider 52 is to become inclined and follow the movement of the tip of the holder 21.

Figure 16:
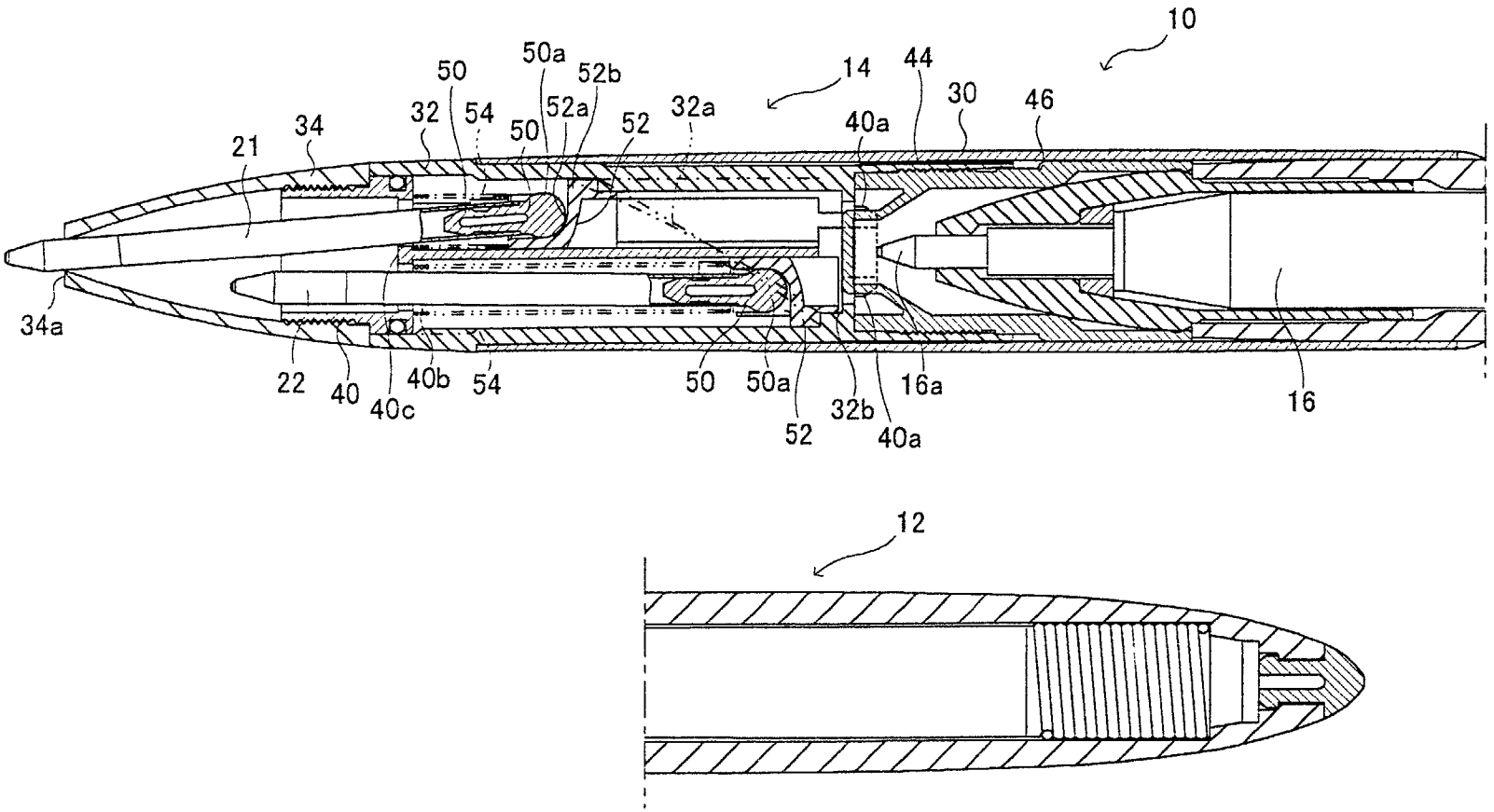
FIG. 16 shows a longitudinal section of a state in which one holder 21 is projected in the first embodiment of the invention.

The tip of the holder 21, while moving along the inner circumferential face of the nose 34, projects out of the fore end opening 34*a*, which is on the axial line. The projection 52*b* of the slider 52 having advanced along the cam face 32*a*, when engaged with the engaging part 32*a* at the tip of the cam face 32*a*, stops in the position to which it has advanced (e.g., the advanced position in FIG. 11). In this way, the tip of the holder 21 supported by the slider 52 is held in a state of projection from the fore end opening 34*a*, as shown in FIG. 16, in which the holder 21 becomes usable. The slider 52 supporting the holder receptacle 50 of the other holder 22 recedes along the cam face 32*a*, and stops in the receded position shown in FIG. 11.

On the other hand, if the nose 34 is turned from the state shown in FIG. 3 in the direction reverse to the foregoing prescribed direction in relation to the intermediate sleeve 32, then the holder 22 will advance, whereas the holder 21 will recede. Then, the spherical part 50*a* of the holder receptacle 50 of the advanced holder 21, as the receptacle advances, comes into sliding contact with the concave part 52*a* of the corresponding slider 52 and turns in relation to the slider 52 to become inclined and follow the movement of the tip of the holder 22. The tip of the holder 22, while moving along the inner circumferential face of the nose 34, projects out of the fore end opening 34*a*, which is on the axial line, as in the above-described movement of the tip of the holder 21.

When the advanced holder 21 or 22 is to be receded, turning the nose 34 in a reverse direction (e.g., the direction reverse to the direction in which it was turned when the holder 21 or 22 was to be advanced in relation to the intermediate sleeve 32), causes the projection 52*b* of the slider 52 supporting the advanced holder to recede in the axial direction along the cam face 32*a* and the projection 52*b* of the slider 52 holding the receded holder advances in the axial direction along the cam face 32*a*, thereby to return to the state shown in FIG. 3. The relationship between the spherical part 50*a* and the concave part 52*a* also returns to its original state.

Thus, the holders 21 and 22 can smoothly project and recede without being caught by the casing 20 or meeting resistance. Since the holders 21 and 22 can therefore project smoothly without having to be bent in themselves, the holders 21 and 22 can be kept short enough to be accommodated in the cap 14 which is not very long, and, for instance, hard metallic pipes can be used for the holders 21 and 22.

Figure 17:
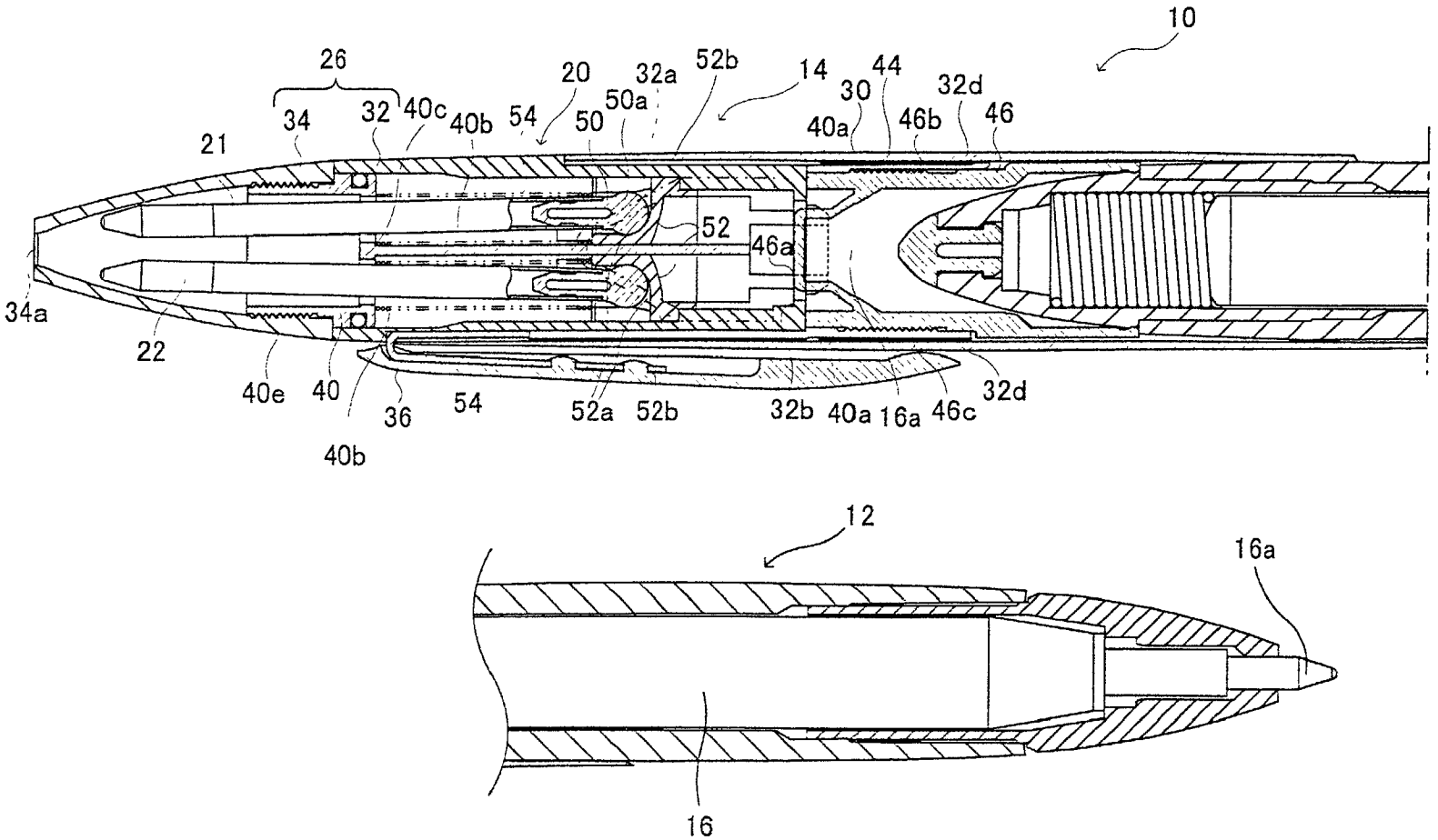
FIG. 17 illustrates a state of use of the holder body in the first embodiment of the invention.

Now, when the holder body 12 of this writing tool 10 is to be used, by removing the cap 14 from the holder body 12 by a usual method and, as shown in FIG. 17, covering the rear end of the holder body 12 with the cap 14, the tip 16*a* of the refill 16 can be exposed to make writing possible with the tip 16*a*.

Hence, since not only the refill 16 built into the holder body 12 but also the plurality of holders 21 and 22 housed in the cap 14 can be selectively used, the range of applicability can be made broader than that of any existing composite holding device.

Figure 27:
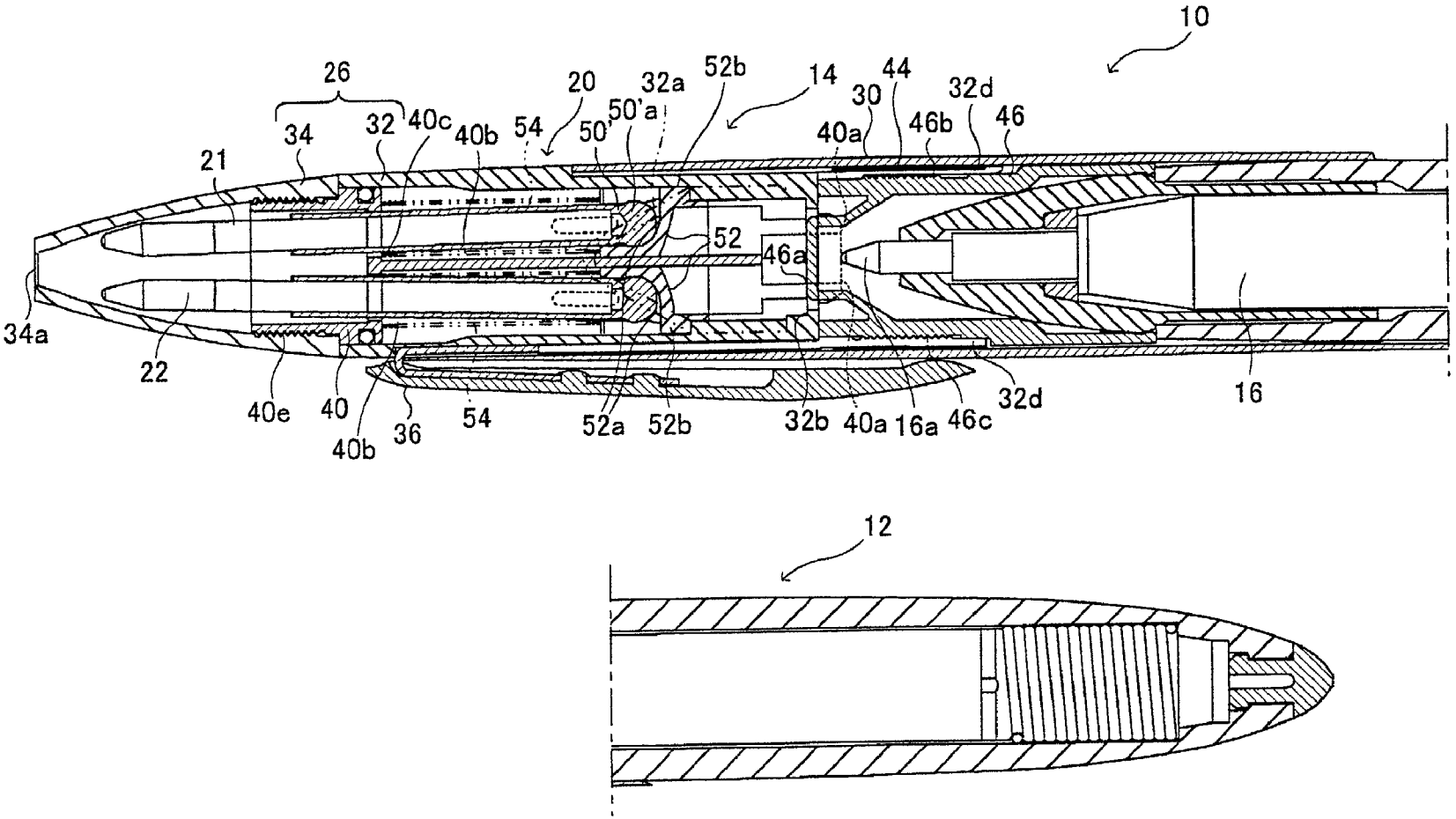
FIG. 27 illustrates a variation of the slider according to invention, corresponding to the drawing shown in FIG. 3.

Although, in the foregoing example, the tip of the holder receptacle 50 is inserted into the holder 21 or 22 as shown in FIG. 3, FIG. 8 etc., the tip of a holder receptacle 50' may as well cover the outside of the holder 21 or 22 as illustrated in FIG. 27. In this way, even where holders 21 and 22 are relatively short, their internal capacities can be sufficiently secured.

Second Embodiment

Figure 18:
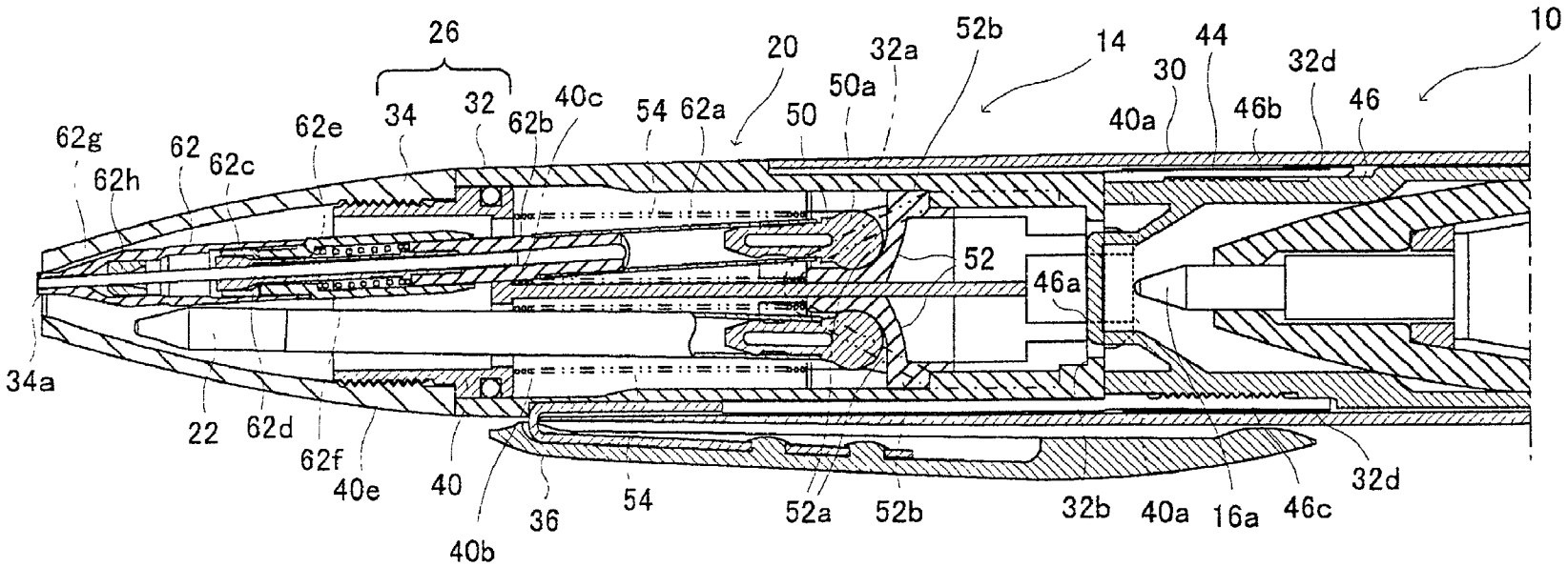
FIG. 18 shows a longitudinal section of a composite holding device, which is a second embodiment of the present invention.

FIG. 18 illustrates a second embodiment of the present invention, wherein the same members as in the first embodiment are assigned respectively the same reference numbers, and their detailed description will be omitted.

In the second embodiment, one of holders 62 is a mechanical pencil stem and the other holder 22 is a ballpoint stem as in the first embodiment. The holder 62, which is a mechanical pencil stem, is configured of a lead tank 62*a* for accommodating leads, a coupling 62*b* to be linked to the lead tank 62*a*, a chuck 62*c* whose rear end is to be pressed into the coupling 62*b*, a chuck ring 62*d* to be fitted around the head of the chuck 62*c,* a sleeve 62*e* to regulate the rear end position of the chuck ring 62*d,* a return spring 62*f* intervening between the sleeve 62*e* and the coupling 62*b*, a nose 62*g* to be connected to the sleeve 62*e,* and a packing 62*h* provided within the nose 62*g*.

Figure 19:
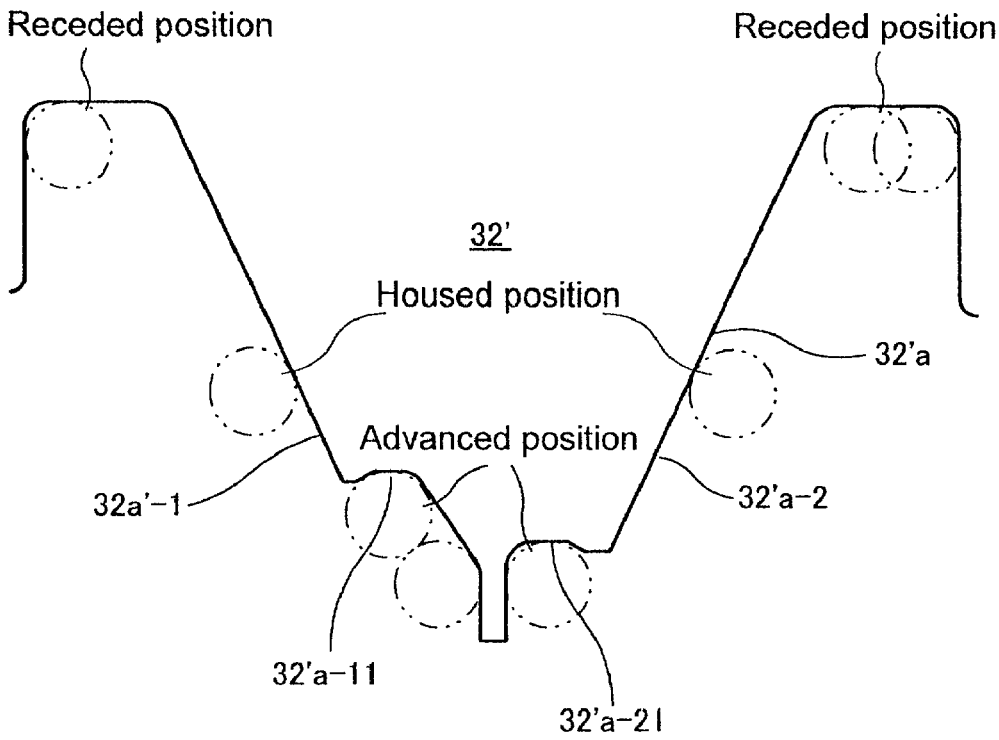
FIG. 19 shows an expansion plan view of the cam face 32'*a* of the intermediate sleeve 32'.
Figure 20:
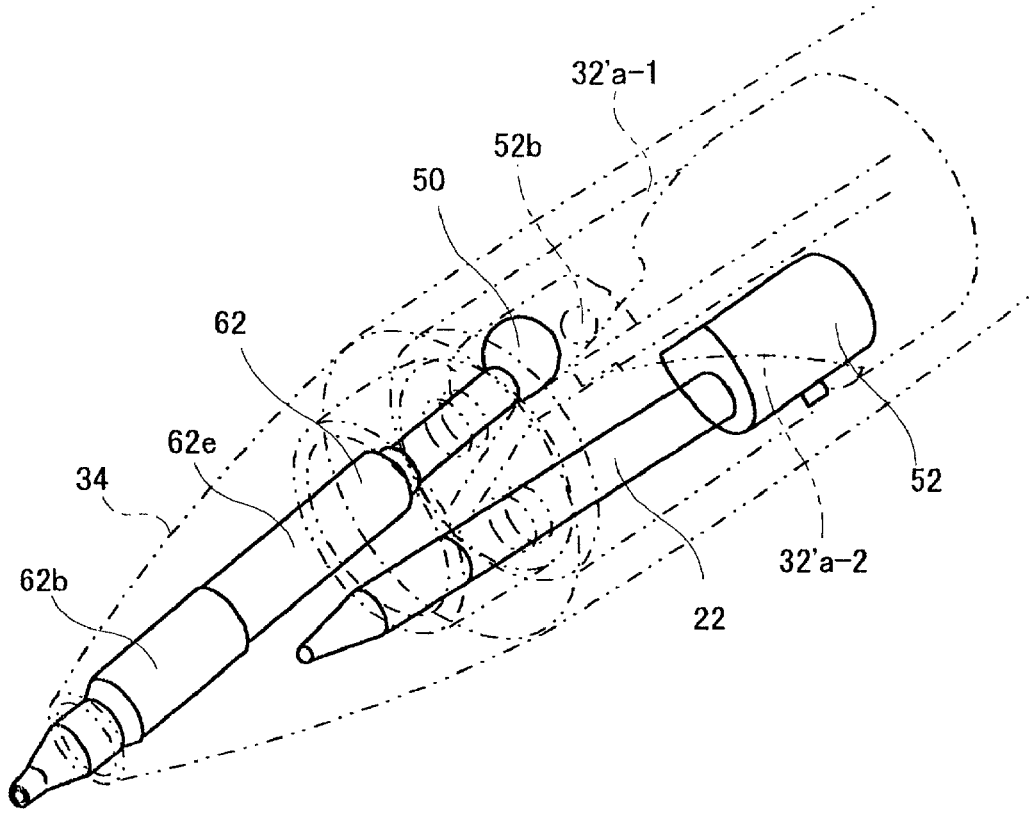
FIG. 20 shows an explanatory perspective view of the second embodiment of the invention.

Further, in the second embodiment, a cam face 32'*a* of an intermediate sleeve 32', as shown in FIG. 19 and FIG. 20, is divided into a cam face part 32'*a*-1 on which the slider 52 corresponding to the mechanical pencil stem 62 slides and a cam face part 32'*a*-2 on which the slider 52 corresponding to the ballpoint stem 22 slides. In a position somewhat rearwardly from the tip of the cam face part 32'*a*-1, an engaging part 32'*a*-11 , which is formed, for example, by a small dent, is formed on the cam face part 32'*a*-1, and in the tip position of the cam face part 32'*a*-2, an engaging part 32'*a*-21, which is formed, for example, by a small dent, is formed on a cam face 32'*b*.

In this embodiment, the tip of the ballpoint stem 22 is projected similarly as in the first embodiment. When the mechanical pencil stem 62 is to be projected, the nose 34 is turned in a prescribed direction in relation to the intermediate sleeve 32', causes the slide receptacle 40 integrated with the nose 34 to turn in the prescribed direction in relation to the intermediate sleeve 32'.

As the sliders 52 and 52 fitted into the guide grooves 40*b* of the slide receptacle 40 also turn integrally, each of the projections 52*b* of the sliders 52 moves in the axial direction along the cam face 32'*a*. The projection 52*b* of the slider 52 supporting the holder receptacle 50 of the mechanical pencil stem 62 advances along the cam face part 32'*a*-1, and the tip of the mechanical pencil stem 62 projects out of the fore end opening 34*a* of the nose 34.

In this operation, when the projection 52*b* approaches the engaging part 32*a*-11, the nose 62*g* of the mechanical pencil stem 62 comes into contact with the surrounding around the fore end opening 34*a* of the nose 34, beyond which it can advance no farther. Further, the lead tank 62*a*, coupling 62*b*, chuck 62*c* and chuck ring 62*d* advance in relation to the nose 62*g* and the sleeve 62*e,* and a lead is fed by a known method.

Figure 21:
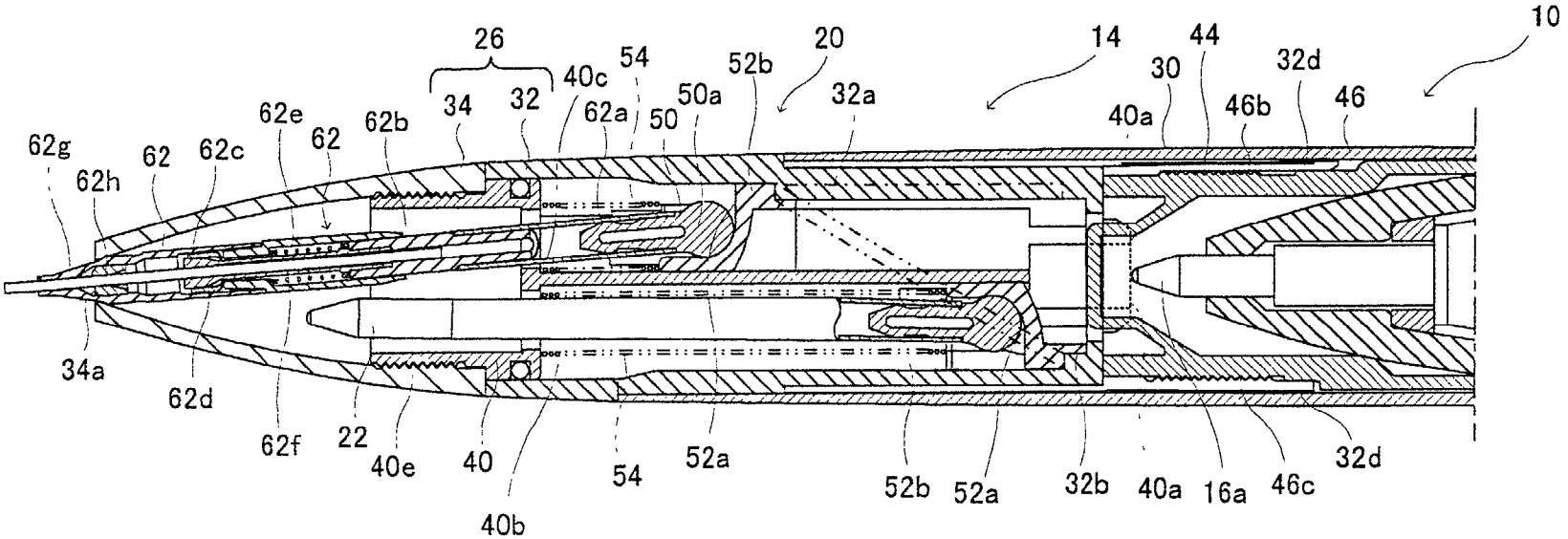
FIG. 21 shows a longitudinal section of the second embodiment of the invention in a state in which a mechanical pencil stem, which is one of the holders 62, is projected.

When the force to turn the nose 34 is decreased, the spring forces of the return spring 54 and another return spring 62*f* cause the projection 52*b* of the slider 52 supporting the mechanical pencil stem 62 to recede to the engaging part 32'*a*-11 and, as shown in FIG. 21, the tip of the mechanical pencil stem 62 is held in a position of projecting out of the fore end opening 34*a*. Further feeding of the lead by a prescribed length at a time is performed by turning the nose 34 in a prescribed direction and thereby moving back and forth the projection 52*b* of the slider 52 supporting the mechanical pencil stem 62 between the position of the engaging part 32'*a*-11 and the tip of the cam face part 32'*a*-1.

In this embodiment, the tip of the holder, which is the mechanical pencil stem 62, can smoothly project out of and recede into the fore end opening 34*a* of the casing 20 without being caught by the casing 20 or meeting resistance as the spherical part 50*a* of its holder receptacle 50 is borne by the concave part 52*a* of the slider 52. Furthermore, since the mechanical pencil stem 62 need not be bent, the lead feed mechanism including the chuck can be prevented from damage such as rupture, bending or lead breaking.

In addition to the above-described embodiments of the invention, the holder may be provided as a stylus pen stem holding a stylus tip, an eraser stem holding an eraser, a stick glue stem holding a stick glue, or a cosmetic stem holding a cosmetic such as a lipstick. Any of these stylus pen stem, eraser stem and cosmetic stem can be configured similarly to the ballpoint stem. However, where the holder holds an expendable item such as an eraser or a cosmetic, the eraser or cosmetic may be held by a needle and the needle is made feedable like the lead in the mechanical pencil stem so that the eraser or cosmetic can be fed.

Further, although the foregoing description of this embodiment assumed the use of two holders, the number of holders is not limited to two, but obviously the invention can as well be applied to a case in which three or more holders are to be housed in the casing 20.

Furthermore, in the foregoing description of this embodiment the supported section provided in each holder is formed as a spherical part and the slider, which is the supporting section, is formed as a concave part to receive the spherical part. However, a converse arrangement in which the slider is formed as a spherical part and a concave part to receive that spherical part is formed on the supported section of the holder may also may be used.

Figure 22:
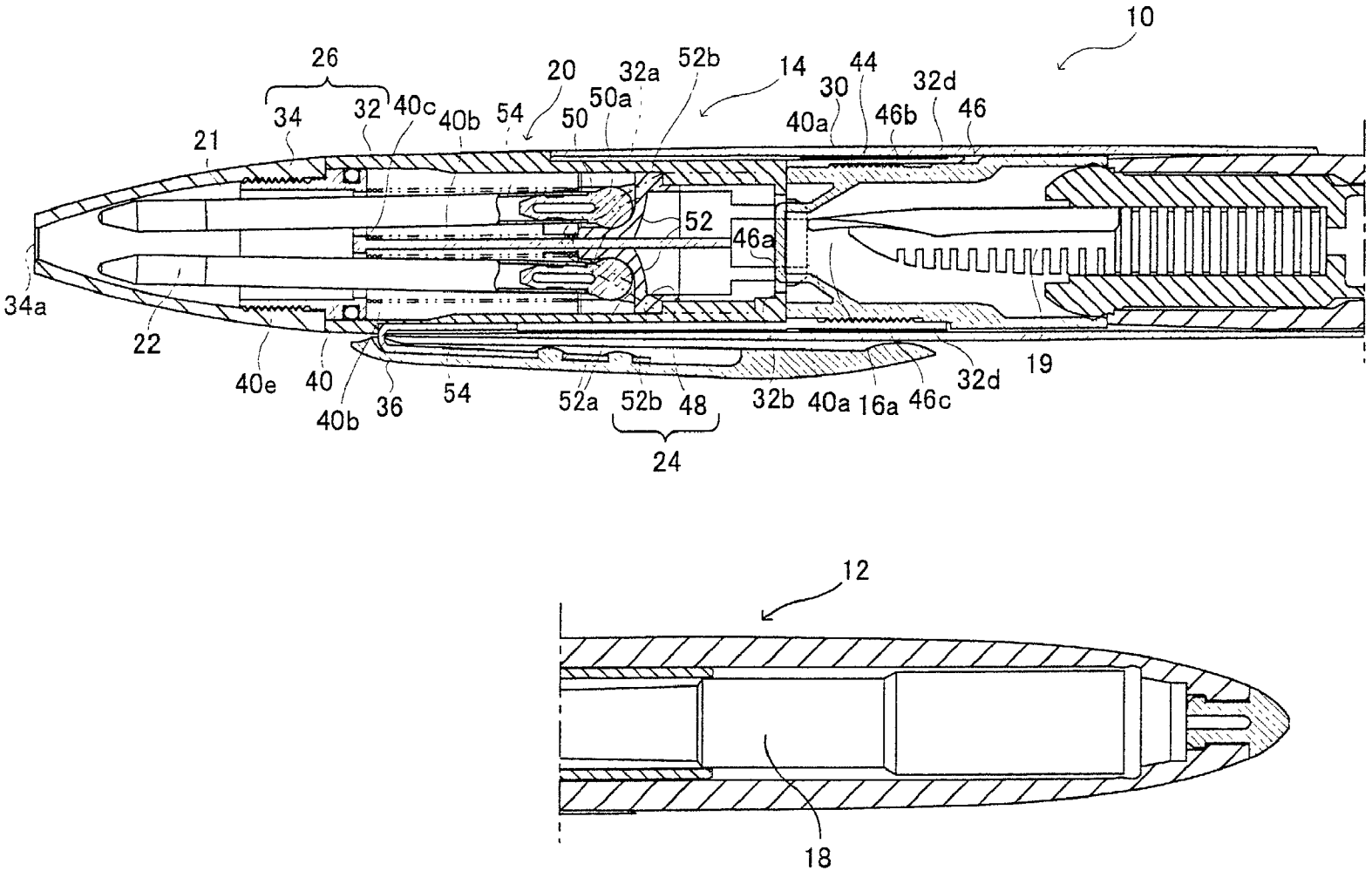
FIG. 22 illustrates a variation of the first embodiment of the invention provided with another holder body.

Further, as shown in FIG. 22, the structure could incorporate a cartridge 18 for containing ink and a pen core unit 19 with which the cartridge 18 is to be coupled can be incorporated into the holder body 12. In this arrangement, writing with the pen core unit 19 can be performed by removing the cap 14 to expose the tip of the pen core unit 19 and putting the cap 14 over the rear end of the holder body 12. As described above, various combinations of the medium held by the holder body 12 and media held by the holders housed in the cap 14 can be realized. However, the possible combinations are not confined to these, and indeed a writing tool may obviously include only the composite holding device described with reference to the conventional structure.

Third Embodiment

Figure 23:
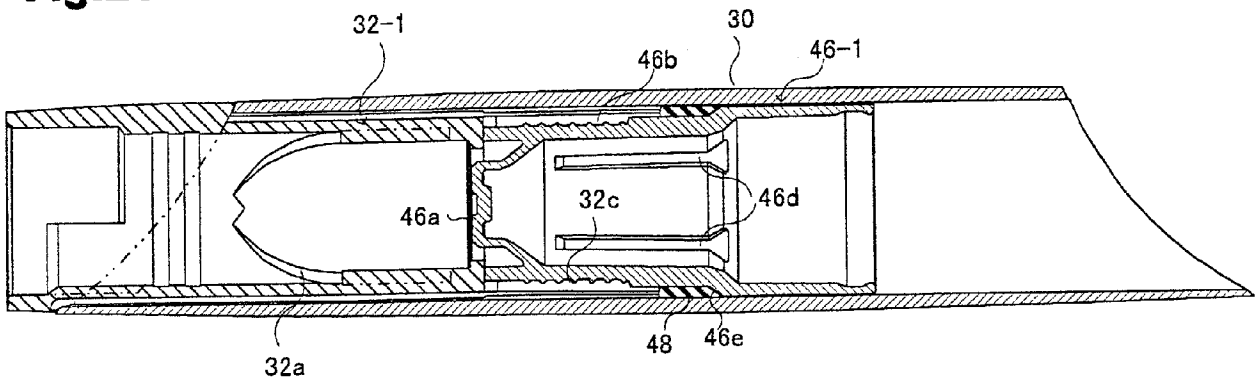
FIG. 23 shows a section of a structure in which the intermediate sleeve 32-1 of a third embodiment of the invention is fitted to the intermediate sleeve.

FIG. 23 illustrates the structure of a third embodiment of the invention in which the intermediate sleeve 32 is fitted to the external sleeve 30. In FIG. 23, the same members as in the first embodiment are assigned respectively the same reference numerals, and their detailed description will be omitted.

This embodiment differs from the first embodiment in that an elastic ring 48 is arranged adjoining an intermediate sleeve 32-1 within the external sleeve 30. Thus, the elastic ring 48 intervenes between a rear end face of the intermediate sleeve 32-1 and a step face 46*e* formed on an outer circumferential face in the part of the internal sleeve 46-1 not inserted into the intermediate sleeve 32-1. The elastic ring 48 may include an elastomer, soft synthetic resin or the like.

Slits 32*d* may be formed on the rear end part of the intermediate sleeve 32-1 as in the first embodiment. However, in this third embodiment, the slits 32*d* also could be dispensed with.

The step face 46*e* of the internal sleeve 46-1 may be a vertical face normal to the axial direction, but more preferably is inclined. The inclined face preferably should face the elastic ring 48 as well as the direction of the external diameter. The outer circumferential face in the tip part of the internal sleeve 46-1 need not be tapered like the tapered face 46*c* in the first embodiment, but may be parallel to the axial direction.

Assembly work for this embodiment is carried out in the following manner. First, the rear end of the intermediate sleeve 32-1 is inserted into the external sleeve 30 and set in a suitable position, and similarly the elastic ring 48 is inserted into the external sleeve 30 and positioned adjacent to the intermediate sleeve 32-1. Then, the internal sleeve 46-1 is inserted into the external sleeve 30 and into the intermediate sleeve 32-1, and a tool is placed into the tool grooves 46*d* on the inner circumferential face of the internal sleeve 46-1 to turn the internal sleeve 46-1, thereby to thread the external thread 46*b* in the tip part of the internal sleeve 46-1 onto the internal thread 32*c* on the intermediate sleeve 32-1.

As the threading is continued and the internal sleeve 46-1 is moved toward the intermediate sleeve 32-1, the step face 46*e* of the internal sleeve 46-1 comes into contact with the rear end of the elastic ring 48, and the elastic ring 48, pinched between the intermediate sleeve 32-1 and the step face 46*e* of the internal sleeve 46-1, is compressed in the axial direction. This causes the elastic ring 48 to expand in the radial direction, and to press against the inner circumferential face of the external sleeve 30. In this process, as the step face 46*e* of the internal sleeve 46-1 is inclined, the elastic ring 48 is progressively pressed in the direction of the external diameter as the step face 46*e* approaches the elastic ring 48.

Hence, the elastic ring 48 is fixed within the external sleeve 30. Further, as the intermediate sleeve 32-1 and the internal sleeve 46-1 are threaded onto each other to pinch the elastic ring 48 between them, the rear end of the intermediate sleeve 32-1 becomes immovable in relation to the external sleeve 30, so that the intermediate sleeve 32-1 is firmly fitted to the external sleeve 30.

The compressed elastic ring 48 is subjected to expansion forces in all directions, and the elastic ring 48, elastically in contact with the intermediate sleeve 32-1 and the internal sleeve 46-1, causes frictional forces to arise between them. These frictional forces prevent the intermediate sleeve 32-1 and the internal sleeve 46-1 from being rotationally moved inadvertently, and the threaded fitting between the internal sleeve 46-1 and the intermediate sleeve 32-1 is prevented from loosening.

The elastic ring 48 need not be long in the axial direction. That is, obviously a short O-ring 48-1 could similarly function as shown in FIG. 24 as a variation of the third embodiment of the invention.

Figure 24:
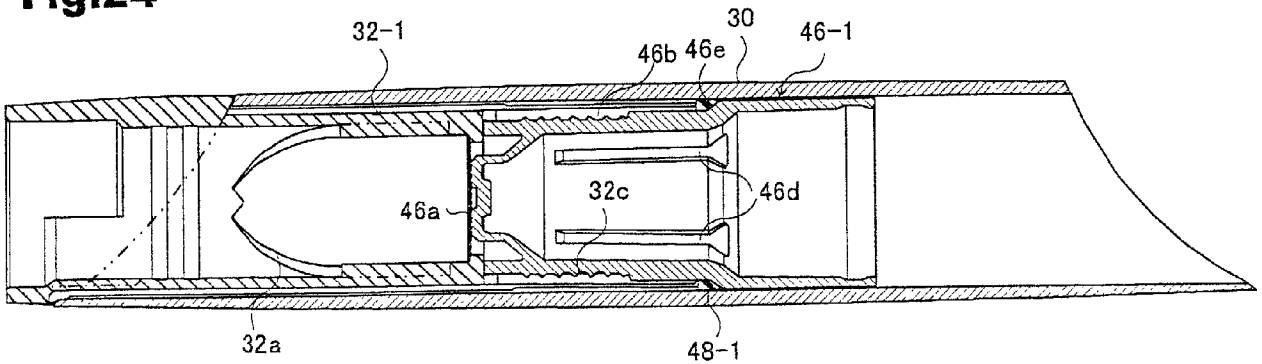
FIG. 24 shows a section of a variation of the third embodiment of the invention.

In the embodiments illustrated in FIG. 23 and FIG. 24, the intermediate sleeve 32-1 and the internal sleeve 46-1 are linked together by threaded engagement of the internal thread 32*c* of the intermediate sleeve 32-1 and the external thread 46*b* of the internal sleeve 46-1 with each other. However, the linking arrangement is not limited thereto. An external thread also could be formed on the intermediate sleeve, and an internal thread to engage with the external thread on the intermediate sleeve, may be formed on the internal sleeve. Further, the rear end part of the intermediate sleeve, instead of the tip part of the internal sleeve, could be caused to penetrate the elastic ring 48 to link the intermediate sleeve and the internal sleeve.

Fourth Embodiment

Figure 25:
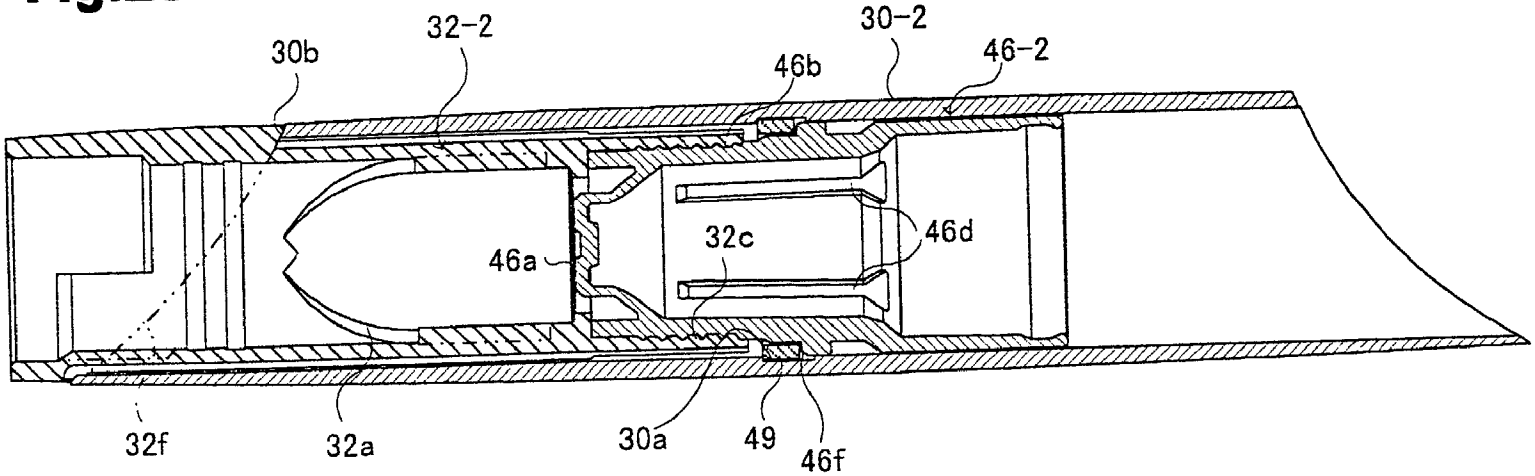
FIG. 25 shows a section of a structure in which the intermediate sleeve of a fourth embodiment of the invention is fitted to the internal sleeve.

Next, FIG. 25 illustrates a fourth embodiment of the present invention. In the drawing, the same members as in the first and third embodiments are assigned respectively the same reference numerals, and thus their detailed description will be omitted.

Figure 26:
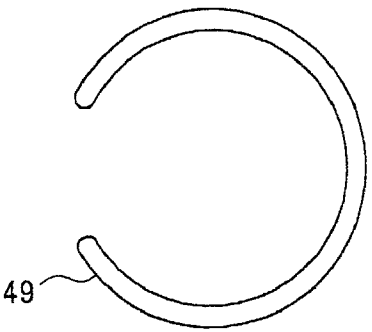
FIG. 26 shows a front view of the C-ring 49 for use in the configuration shown in FIG. 25.

On an inner circumferential face of the external sleeve 30-2 in this embodiment is formed an annular concave part 30*a*. Into this annular concave part 30*a* is fitted a C-ring 49. The C-ring 49, which may be made of either metal or resin, has one cut part as shown in FIG. 26, and can be deformed by either expansion or compression in the radial direction. Therefore, when the C-ring 49 is to be fitted into the annular concave part 30*a* of the external sleeve 30-2, it can be accomplished by shifting the C-ring 49 within the external sleeve 30-2 to the annular concave part 30*a* while compressing it in the direction of the internal diameter. The C-ring 49, in the state of being fitted into the annular concave part 30*a*, the most inward part of the C-ring 49 projects more in the direction of the internal diameter than any part of the inner circumferential face other than the annular concave part 30*a* of the external sleeve 30-2.

A step face 46*f* to be in contact with the C-ring 49 projecting in the direction of the internal diameter is formed on the outer circumferential face of the internal sleeve 46-2.

There is no need to form slits 32*d*, like those in the first embodiment, at the rear end of the intermediate sleeve 32-2. Further, it is unnecessary to taper the outer circumferential face of the tip of the internal sleeve 46-2 like the tapered face 46*c* in the first embodiment.

Assembly work for this embodiment is carried out in the following manner. First, the C-ring 49 is fitted in advance in the annular concave part 30*a* of the external sleeve 30-2 as described above. Then, the rear end of the intermediate sleeve 32-2 is inserted from the tip of the external sleeve 30-2 to bring into contact a step face 32*f*, which forms the boundary line between the tip part and the rear end part of the intermediate sleeve 32-2, with the tip face 30*b* of the external sleeve 30-2. Preferably, then, the rear end part of the intermediate sleeve 32-2, which is its inserted end, and the C-ring 49 are separated from each other in the axial direction.

Then, the internal sleeve 46-2 is inserted from the rear end of the external sleeve 30-2, and the tip of the internal sleeve 46-2 is caused to penetrate the C-ring 49 and inserted into the intermediate sleeve 32-2. A tool is placed into the tool grooves 46*d* on the inner circumferential face of the internal sleeve 46-2 to turn the internal sleeve 46-2, thereby to thread the external thread 46*b* in the tip part of the internal sleeve 46-2 onto the internal thread 32*c* on the intermediate sleeve 32-2.

As the threading is continued and the internal sleeve 46-2 is moved toward the intermediate sleeve 32-2, the step face 46*f* of the internal sleeve 46-2 comes into contact with the rear end of the C-ring 49, and the internal sleeve 46-2 can be moved no farther toward the intermediate sleeve 32-2. In this state, the intermediate sleeve 32-2 and the internal sleeve 46-2 linked by the threading pinch between the tip face 30*b* of the external sleeve 30-2 and the rear end face of the C-ring 49, with the result that the intermediate sleeve 32-2 is firmly fitted to the external sleeve 30-2.

In this embodiment, the intermediate sleeve 32-2 can be more firmly fitted to the external sleeve 30-2. Further, where the internal diameter of the C-ring and the external diameter of the tip part of the internal sleeve 46-2 are so set that the tip part of the internal sleeve 46-2 penetrating the C-ring 49 come into contact with the inner circumferential face of the C-ring 49, frictional forces arise between them. These frictional forces prevent the internal sleeve 46-2 from being turned inadvertently, thereby preventing the threaded fitting between the internal sleeve 46-2 and the intermediate sleeve 32-2 from loosening.

In the embodiment illustrated in FIG. 25, the intermediate sleeve 32-2 and the internal sleeve 46-2 are linked together by threaded engagement of the internal thread 32*c* of the intermediate sleeve 32-2 and the external thread 46*b* of the internal sleeve 46-2 with each other, but the linking arrangement is not limited thereto. An external thread could be formed on the intermediate sleeve, and an internal thread to engage with the external thread on the intermediate sleeve, on the internal sleeve may be formed. The rear end part of the intermediate sleeve (instead of the tip part of the internal sleeve) could be caused to penetrate the C-ring 49 to link the intermediate sleeve and the internal sleeve.

While the invention has been described in terms of several preferred embodiments, those skilled in the art will recognize that the invention can be practiced with modification within the spirit and scope of the appended claims.

What is claimed is:

1. A composite holding device, comprising:

a casing for accommodating a plurality of holders for holding media to serve either different or similar purposes;

supporting sections, each of which supports a corresponding holder and movable in an axial direction in the casing together with the holder;

a feed mechanism, provided in the casing, for selectively advancing one of the supporting sections; and a manipulating mechanism for operating the feed mechanism, being adapted to project a tip of one of the plurality of holders out of a fore end opening at a tip of the casing and make usable the tip of one of the plurality of holders, wherein each supporting section is adapted to support a section of each holder such that the supported section is adapted to be rotatably supported in relation to the supporting section, wherein a spherical bearing is formed between said supporting section and the supported section provided on each of said holders, wherein said spherical bearing includes a spherical part formed on either one of said supporting section and the supported section provided on a holder and a concave part formed on the other one of said supporting section and supported section provided on the holder to receive said spherical part.

2. The composite holding device, as set forth in claim 1, wherein said media are selected from a group of media consisting of writing-related media including a pencil lead, an ink, a stick glue, an eraser and a correctional fluid, cosmetic media including a lipstick, an eye pencil, an eyeliner and an eyebrow pencil, and data inputting media including a stylus tip.

3. A writing tool comprising:

a cap into which the composite holding device set forth in claim 1 is built.

4. The device of claim 1, wherein said supported section comprises a holder receptacle comprising said spherical part.

5. The device of claim 4, wherein said holder comprises a ballpoint stem and said holder receptacle.

6. The device of claim 1, wherein said supporting section comprises a slider comprising said concave part.

7. A composite holding device, comprising:

a holder body for holding a first medium to serve a prescribed purpose; and a cap for detachably covering the holder body, wherein the cap comprises:

a casing for accommodating a plurality of holders, each holder for holding a second medium to serve a purpose either different from or similar to that of said first medium;

a supporting section for supporting said holders to be movable in an axial direction in the casing;

a feed mechanism, provided in the casing, for selectively advancing one of the plurality of holders; and a manipulating mechanism for operating the feed mechanism being adapted to project a tip of one of the plurality of holders out of a fore end opening at a tip of the casing and make usable the tip of one of the plurality of holders, wherein the supporting section is adapted to support a section of each holder such that the supported section is adapted to be rotatably supported in relation to the supporting section.

8. A composite holding device, comprising:

a holder body for holding a first medium to serve a prescribed purpose; and a cap for detachably covering the holder body, wherein the cap comprises:

a casing for accommodating a plurality of holders, each holder for holding a second medium to serve a purpose either different from or similar to that of said first medium;

a supporting section for supporting said holders to be movable in an axial direction in the casing;

a feed mechanism, provided in the casing, for selectively advancing one of the plurality of holders; and a manipulating mechanism for operating the feed mechanism being adapted to project a tip of one of the plurality of holders out of a fore end opening at a tip of the casing and make usable the tin of one of the plurality of holders; and a spherical bearing formed between said supporting section and a supported section provided on each of said holders.

9. The composite holding device, as set forth in claim 8, wherein said spherical bearing includes:

a spherical part formed on either one of said supporting section and said supported section provided on said holders; and a concave part formed on the other one of said supporting section and said supported section provided on the holders to receive said spherical part.

10. A composite holding device, comprising:

a casing for accommodating a plurality of holders for holding media to serve either different or similar purposes;

a supporting section for supporting said holders to be movable in an axial direction in the casing;

a feed mechanism, provided in the casing, for selectively advancing one of the plurality of holders; and a manipulating mechanism for operating the feed mechanism, being adapted to project a tip of one of the plurality of holders out of a fore end opening at a tip of the casing and make usable the tip of one of the plurality of holders, wherein:

said casing comprises an external sleeve, an intermediate sleeve fitted inside the external sleeve with assistance of an ancillary sleeve, and a nose rotatable in relation to the external sleeve and the intermediate sleeve;

an internal thread is formed on an inner circumferential face of the intermediate sleeve and a slit is formed on an internally threaded part of the intermediate sleeve;

an external thread is formed on an outer circumferential face of the ancillary sleeve;

one of an externally threaded part of the ancillary sleeve and the internally threaded part of the intermediate sleeve has a tapered shape; and the external thread of said ancillary sleeve inserted into the external sleeve and the intermediate sleeve engages the internal thread of the intermediate sleeve inserted into the external sleeve, the slit of the intermediate sleeve being expanded to press the internally threaded part against an inner circumferential face of the external sleeve to fix the intermediate sleeve to the external sleeve, thereby to fit the intermediate sleeve inside the external sleeve.

11. The composite holding device, as set forth in claim 10, wherein a projection to be pressed against the inner circumferential face of the external sleeve is formed on an outer circumferential face of the internally threaded part of said intermediate sleeve.

12. The composite holding device, as set forth in claim 10, wherein one of an adhesive tape and an elastic member is positioned between the outer circumferential face of the internally threaded part of said intermediate sleeve and the inner circumferential face of the external sleeve.

13. A composite holding device, comprising:

a casing for accommodating a plurality of holders for holding media to serve either different or similar purposes;

a supporting section for supporting said holders to be movable in an axial direction in the casing;

a feed mechanism, provided in the casing, for selectively advancing one of the plurality of holders; and a manipulating mechanism for operating the feed mechanism, being adapted to project a tip of one of the plurality of holders out of a fore end opening at a tip of the casing and make usable the tip of one of the plurality of holders, wherein:

said casing comprises an external sleeve, an intermediate sleeve fitted inside the external sleeve with assistance of an ancillary sleeve and an elastic ring, and a nose rotatable in relation to die external sleeve and the intermediate sleeve;

an internal thread is formed on either one of the intermediate sleeve and the ancillary sleeve, and an external thread to engage the internal thread is formed on the other one of the intermediate sleeve and the ancillary sleeve;

the intermediate sleeve and the elastic ring adjacent to the intermediate sleeve in the axial direction, are inserted into the external sleeve, the ancillary sleeve is inserted into the external sleeve from the elastic ring side, one of a part of the ancillary sleeve and a part of the intermediate sleeve penetrates the elastic ring, the threaded engagement of said external thread and internal thread with each other serves to combine the intermediate sleeve and the ancillary sleeve, and the elastic ring is compressed in the axial direction between the ancillary sleeve and the intermediate sleeve to be pressed against an inner circumferential face of the external sleeve and thereby to be fixed to the external sleeve, thereby resulting in the fitting of the intermediate sleeve inside the external sleeve.

14. The composite holding device, as set forth in claim 13, wherein a step face for coming into contact with said elastic ring is formed on said ancillary sleeve, and the step face is inclined in relation to the direction of the external diameter.

15. A composite holding device, comprising:

a casing for accommodating a plurality of holders for holding media to serve either different or similar purposes;

a supporting section for supporting said holders to be movable in an axial direction in the casing;

a feed mechanism, provided in the casing, for selectively advancing one of the plurality of holders; and a manipulating mechanism for operating the feed mechanism, being adapted to project a tip of one of the plurality of holders out of a fore end opening at a tip of the casing and make usable the tip of one of the plurality of holders, wherein:

said casing comprises an external sleeve, and intermediate sleeve fitted inside the external sleeve with the assistance of an ancillary sleeve and a C-ring, and a nose rotatable in relation to the external sleeve and the intermediate sleeve;

an annular concave part is formed on an inner circumferential face of the external sleeve, and the C-ring is fitted into the annular concave part to project more in the direction of the internal diameter than the inner circumferential face of the external sleeve;

an internal thread is formed on either one of the intermediate sleeve and the ancillary sleeve, and an external thread to engage the internal thread is formed on the other one of the intermediate sleeve and the ancillary sleeve;

a part of the intermediate sleeve is inserted into the external sleeve from one end of the external sleeve, and the other part of the intermediate sleeve not inserted into the external sleeve is brought into contact with the one end of the external sleeve; and the ancillary sleeve is inserted into the external sleeve from the other end of the external sleeve, one of a part of the ancillary sleeve and a part of the intermediate sleeve penetrates the C-ring, the threaded engagement of said external thread with the internal thread serves to combine the intermediate sleeve and the ancillary sleeve, and the ancillary sleeve comes into contact with the part of the C-ring projecting more than the inner circumferential face of the external sleeve from the other end side of the external sleeve, thereby resulting in fitting the intermediate sleeve inside the external sleeve.

16. A composite holding device, comprising:

a holder body for holding a medium to serve a prescribed purpose; and a cap for detachably covering the holder body, wherein the cap comprises:

a casing for accommodating a plurality of holders, each holder for holding a medium to serve a purpose either different from or similar to that of said medium;

a supporting section for supporting said holders to be movable in an axial direction in the casing;

a feed mechanism, provided in the casing, for selectively advancing one of the plurality of holders; and a manipulating mechanism for operating the feed mechanism, being adapted to project a tip of one of the plurality of holders out of a fore end opening at a tip of the casing and make usable the tip of one of the plurality of holders, wherein:

said casing comprises an external sleeve, an intermediate sleeve fitted inside the external sleeve with the assistance of an ancillary sleeve, and a nose rotatable in relation to the external sleeve and the intermediate sleeve;

an internal thread is formed on an inner circumferential face of the intermediate sleeve and a slit is formed on an internally threaded part of the intermediate sleeve;

an external thread is formed on an outer circumferential face of the ancillary sleeve;

one of an externally threaded part of the ancillary sleeve and the internally threaded part of the intermediate sleeve has a tapered shape; and the internal thread of the intermediate sleeve inserted into the external sleeve engages with the external thread of said ancillary sleeve inserted into the external sleeve and the intermediate sleeve, the slit of the intermediate sleeve being expanded to press the internally threaded part against an inner circumferential face of the external sleeve to fix the intermediate sleeve to the external sleeve, thereby to fit the intermediate sleeve inside the external sleeve.

17. A composite holding device, comprising:

a holder body for holding a medium to serve a prescribed purpose; and a cap for detachably covering the holder body, wherein the cap comprises:

a casing for accommodating a plurality of holders, each holder for holding a medium to serve a purpose either different from or similar to that of said medium;

a supporting section for supporting said holders to be movable in an axial direction in the casing;

a feed mechanism, provided in the casing, for selectively advancing one of the plurality of holders; and a manipulating mechanism for operating the feed mechanism, being adapted to project a tip of one of the plurality of holders out of a fore end opening at a tip of the casing and make usable the tip of one of the plurality of holders, wherein:

said casing comprises an external sleeve, an intermediate sleeve fitted inside the external sleeve with assistance of an ancillary sleeve and an elastic ring, and a nose rotatable in relation to the external sleeve and the intermediate sleeve;

an internal thread is formed on either one of the intermediate sleeve and the ancillary sleeve, and an external thread to engage with the internal thread is formed on the other one of the intermediate sleeve and the ancillary sleeve;

the intermediate sleeve and the elastic ring adjacent to the intermediate sleeve in the axial direction, are inserted into the external sleeve, the ancillary sleeve is inserted into the external sleeve from the elastic ring side, one of a part of the ancillary sleeve and a part of the intermediate sleeve penetrates the elastic ring, the threaded engagement of said external thread and internal thread with each other serves to combine the intermediate sleeve and the ancillary sleeve, and the elastic ring is compressed in the axial direction between the ancillary sleeve and the intermediate sleeve to be pressed against an inner circumferential face of the external sleeve, thereby to be fixed to the external sleeve, thereby resulting in the fitting of the intermediate sleeve inside the external sleeve.

18. A composite holding device, comprising:

a holder body for holding a medium to serve a prescribed purpose; and a cap for detachably covering the holder body, wherein the cap comprises:

a casing for accommodating a plurality of holders, each holder for holding a medium to serve a purpose either different from or similar to that of said medium;

a supporting section for supporting said holders to be movable in an axial direction in the casing;

a feed mechanism, provided in the casing, for selectively advancing one of the plurality of holders; and a manipulating mechanism for operating the feed mechanism, being adapted to project a tip of one of the plurality of holders out of a fore end opening at a tip of the casing and make usable the tip of one of the plurality of, wherein:

said casing comprises an external sleeve, an intermediate sleeve fitted inside the external sleeve with the assistance of an ancillary sleeve and a C-ring, and a nose rotatable in relation to the external sleeve and the intermediate sleeve;

an annular concave part is formed on an inner circumferential face of the external sleeve, and the C-ring is fitted into the annular concave part to project more in a direction of the internal diameter than the inner circumferential face of the external sleeve;

an internal thread is formed on either one of the intermediate sleeve and the ancillary sleeve, and an external thread to engage with the internal thread is formed on the other one of the intermediate sleeve and the ancillary sleeve;

a part of the intermediate sleeve is inserted into the external sleeve from one end of the external sleeve, and the other part of the intermediate sleeve not inserted into the external sleeve is brought into contact with the one end of the external sleeve; and the ancillary sleeve is inserted into the external sleeve from the other end of the external sleeve, one of a part of the ancillary sleeve and a part of the intermediate sleeve penetrates the C-ring, the threaded engagement of said external thread with internal thread serves to combine the intermediate sleeve and the ancillary sleeve, and the ancillary sleeve comes into contact with the part of the C-ring projecting more than the inner circumferential face of the external sleeve form the other end side of the external sleeve, thereby resulting in the fitting of the intermediate sleeve inside the external sleeve.

19. A holding device, comprising:

a casing for accommodating a plurality of holders for holding media;

a supporting section for supporting said holders to be movable;

means for selectively advancing one of the plurality of holders; and means for operating the advancing means, being adapted to project a tip of one of the plurality of holders out of a fore end opening at a tip of the casing and make usable the tip of one of the plurality of holders, wherein the supporting section is adapted to support a section of each holder such that the supported section is adapted to be rotatably supported in relation to the supporting section, wherein said supporting section supports each section of each holder with a spherical bearing.

20. The device of claim 19, wherein said spherical bearing comprises a spherical part formed on one of said supporting section and said supported section of said holders and a concave part that receives said spherical part formed on the other one of said supporting section and said supported section of said holders.

21. The device of claim 20, wherein said supported section of each holder comprises a holder receptacle comprising said spherical part.

22. The device of claim 20, wherein said supporting section comprises a slider comprising said concave part.

* * * * *

UNITED STATES PATENT AND TRADEMARK OFFICE

CERTIFICATE OF CORRECTION

PATENT NO. : 7,008,131 B2
APPLICATION NO. : 10/026467
DATED : March 7, 2006
INVENTOR(S) : Hidehei Kageyama et al.

It is certified that error appears in the above-identified patent and that said Letters Patent is hereby corrected as shown below:

On the title page, item: [75] Inventors, replace "Hidehei Kagevarna" with --Hidehei Kageyama-- on the cover page.

Signed and Sealed this

Eighteenth Day of July, 2006

JON W. DUDAS
*Director of the United States Patent and Trademark Office*